US007494556B2

(12) United States Patent
Von Mertz

(10) Patent No.: US 7,494,556 B2
(45) Date of Patent: Feb. 24, 2009

(54) INSTALLATION ELEMENTS AND METHODS FOR FASTENING AN INSTALLATION ELEMENT TO A WORK SURFACE

(75) Inventor: Gert Spruner Von Mertz, Eppingen (DE)

(73) Assignee: Blanco GmbH + Co KG, Oberderdingen (DE)

( * ) Notice: Subject to any disclaimer, the term of this patent is extended or adjusted under 35 U.S.C. 154(b) by 495 days.

(21) Appl. No.: 11/057,961

(22) Filed: Feb. 15, 2005

(65) Prior Publication Data

US 2005/0205193 A1 Sep. 22, 2005

Related U.S. Application Data

(63) Continuation of application No. PCT/EP03/08982, filed on Aug. 13, 2003.

(30) Foreign Application Priority Data

Aug. 16, 2002 (DE) ..... 102 37 556

(51) Int. Cl.

| | |
|---|---|
| ***B29C 65/70*** | (2006.01) |
| ***B29C 65/76*** | (2006.01) |
| ***B32B 37/14*** | (2006.01) |
| ***B32B 38/10*** | (2006.01) |

(52) U.S. Cl. ..... 156/71; 156/83; 156/250

(58) Field of Classification Search ..... 156/71, 156/83, 242, 250, 308.2, 82

See application file for complete search history.

(56) References Cited

U.S. PATENT DOCUMENTS 2,989,430 A * 6/1961 Pulaski ..... 156/438
3,143,743 A * 8/1964 Just ..... 4/633

(Continued)

FOREIGN PATENT DOCUMENTS

DE 1920893 A 11/1970

(Continued)

OTHER PUBLICATIONS

European Patent Office Search Report for European Patent Application No. 04 012 865.4, Nov. 3, 2004 (3 pages).

(Continued)

*Primary Examiner*—Philip C Tucker
*Assistant Examiner*—Sing P Chan
(74) *Attorney, Agent, or Firm*—Hanley, Flight & Zimmerman, LLC

(57) ABSTRACT

Methods to fasten an installation element, in particular a sink, to the edge of a receiving opening for the installation element in a work surface are disclosed, wherein the installation element has at least one holding element, which enables the installation element to be fastened simply and quickly to the work surface. A disclosed method comprises: (a) arranging a variable-volume material on the installation element and/or on the holding element and/or on the work surface and/or between the installation element and the work surface; (b) arranging the installation element in the receiving opening of the work surface; (c) changing the volume of the variable-volume material, so that a clamping body is formed from the variable-volume material, which exerts a resultant force on the holding element of the installation element, which causes the installation element to be pulled towards the work surface.

34 Claims, 14 Drawing Sheets

U.S. PATENT DOCUMENTS

| | | | | | |
|---|---|---|---|---|---|
| 3,473,829 | A | * | 10/1969 | Daniels | 285/18 |
| 3,585,657 | A | * | 6/1971 | Jensen et al. | 4/633 |
| 3,855,159 | A | * | 12/1974 | Russell | 521/189 |
| 4,039,077 | A | | 8/1977 | Sorenson | |
| 4,584,822 | A | | 4/1986 | Fielding et al. | |
| 4,613,995 | A | * | 9/1986 | Ricke | 4/634 |
| 5,653,550 | A | | 8/1997 | Mutz et al. | |
| 5,860,172 | A | | 1/1999 | Pfeiffer | |
| RE37,253 | E | | 7/2001 | Moren et al. | |
| 6,308,351 | B1 | | 10/2001 | Franke | |
| 6,382,422 | B1 | | 5/2002 | Bocek | |
| D508,555 | S | | 8/2005 | Ziemann | |
| D518,881 | S | | 4/2006 | Ziemann | |
| 7,040,063 | B2 | * | 5/2006 | Leconte | 52/204.62 |
| 2003/0041374 | A1 | | 3/2003 | Franke | |
| 2004/0078892 | A1 | | 4/2004 | Albarran | |
| 2005/0263427 | A1 | | 12/2005 | Schneider et al. | |

FOREIGN PATENT DOCUMENTS

| | | | | |
|---|---|---|---|---|
| DE | 1 628 684 | | | 12/1970 |
| DE | 1628684 | | | 12/1970 |
| DE | 2640935 | A1 | | 3/1977 |
| DE | 2813088 | A | | 10/1979 |
| DE | 7820319 | U1 | | 12/1979 |
| DE | 3 110 134 | | | 10/1982 |
| DE | 3925590 | A | | 2/1991 |
| DE | 4241023 | A | | 6/1994 |
| DE | 4437630 | | | 1/1996 |
| DE | 29620839 | U1 | | 3/1997 |
| DE | 29822399 | U1 | | 4/1999 |
| EP | 0685021 | B1 | | 12/1995 |
| EP | 0 709 528 | | | 5/1996 |
| EP | 0 976 881 | | | 2/2000 |
| EP | 1 103 665 | | | 5/2001 |
| EP | 1188685 | A2 | | 3/2002 |
| FR | 1 319 427 | | | 3/1963 |
| FR | 1319427 | | | 3/1963 |
| FR | 2430532 | | | 7/1979 |
| FR | 2 832 440 | | | 5/2003 |
| GB | 2108195 | A | | 5/1983 |
| GB | 2263060 | A | | 7/1993 |
| JP | 63272682 | | | 11/1988 |
| JP | 10029684 | | | 2/1998 |
| NL | 8201555 | | | 11/1983 |
| WO | WO 0230696 | A1 | * | 4/2002 |

OTHER PUBLICATIONS

European Patent Office Search Report for European Patent Application No. 04 012 866.2, Nov. 12, 2004 (3 pages).

International Search Report corresponding to International Application No. PCT/EP2004/012840 (5 pages).

Office action of German Patent Office corresponding to German Application No. 103 55 032.1 (2 pages).

International Search Report corresponding to International Application Serial No. PCT/EP2004/007830, Oct. 5. 2004, 3 pages.

Ziemann, Brigitte, U.S. Appl. No. 29/225,634, filed Mar. 18, 2005 for "Sink."

Schneider, Wolfgang, U.S. Appl. No. 11/140,830, filed May 31, 2005 for "Built-Under Sinks."

Ziemann, Brigitte, U.S. Appl. No. 29/242,599, filed Nov. 10, 2005 for "Sink Performa V2 Big Single."

Ziemann, Brigitte, U.S. Appl. No. 29/242,618, filed Nov. 10, 2005 for "Sink Performa K4 2.0 Small."

Ziemann, Brigitte, U.S. Appl. No. 29/242,607, filed Nov. 10, 2005, for "Sink Performa K4 1.0 Large."

Ziemann, Brigitte, U.S. Appl. No. 29/242,581, filed Nov. 10, 2005, for "Sink Performa K3 30 1.5."

Ziemann, Brigitte, U.S. Appl. No. 29/242,612, filed Nov. 10, 2005 for "Sink Performa V2 Single Bar."

Ziemann, Brigitte, U.S. Appl. No. 29/242,611, filed Nov. 10, 2005 for "Sink Performa K4 1.5."

Ziemann, Brigitte, U.S. Appl. No. 29/242,627, filed Nov. 10, 2005 for "Sink Performa K4 1.75."

Ziemann, Brigitte, U.S. Appl. No. 29/242,600, filed Nov. 10, 2005 for "Sink Performa V2 33 1.75 Left."

Schnedier, Wolfgang et al., U.S. Appl. No. 29/256,748, filed Mar. 24, 2006 for "Sink."

Ziemann, Brigitte, U.S. Appl. No. 29/242,626, filed Nov. 10, 2005 for "Sink Performa K3 30 Single Bar."

Schneider, Wolfgang, U.S. Appl. No. 29/240,298, filed Oct. 11, 2005, for "Sink."

Ziemann, Brigitte, U.S. Appl. No. 29/242,610, filed Nov. 10, 2005 for "Sink Performa V2 Double."

Von Mertz, Gert Spruner et al., U.S. Appl. No. 11/321,683, filed Dec. 28, 2005 for "A Movement Mechanism for Moving a Closure Element for the Purposes of Sealing a Waste Outlet Opening."

Schneider, Wolfgang et al., U.S. Appl. No. 11/403,315, filed Apr. 13, 2006 for "Sink."

Ziemann, Brigitte, U.S. Appl. No. 29/242,523, filed Nov. 10, 2005 for "Sink Performa K3 30 Double."

Ziemann, Brigitte, U.S. Appl. No. 29,242,608, filed Nov. 10, 2005 for "Sink Performa K4 1.0 Super Single."

Schneider, Wolfgang et al., U.S. Appl. No. 10/872,855, filed Jun. 21, 2004 for "Packaging for a Sink."

* cited by examiner 100
102
106
122
134
146
148
192
196
198
200
II

INSTALLATION ELEMENTS AND METHODS FOR FASTENING AN INSTALLATION ELEMENT TO A WORK SURFACE

RELATED APPLICATION

This patent arises from a continuation of International Patent Application PCT/EP2003/08982, which was filed on 13 Aug. 2003 and which is incorporated herein by reference in its entirety.

FIELD OF THE DISCLOSURE

The present disclosure relates to installation elements, in particular sinks, for insertion into a receiving opening of a work surface, wherein the installation element has at least one holding element.

The present disclosure additionally relates to methods for fastening an installation element, in particular a sink, to the edge of a receiving opening for the installation element in a work surface, wherein the installation element has at least one holding element.

BACKGROUND

Installation elements and methods for fastening them to a work surface are known from the prior art.

Thus, an installation element is known from DE 44 37 630 C1, for example, which has a holding element configured as a holding web and can be fastened in a recess of a work surface by inserting the holding bar into holding clamps fastened to the edge of the recess and anchoring it by latching it in the holding clamps.

The disadvantage with this known method is that additional structural parts are required, namely the holding clamps to be fastened to the work surface, and that the edge of the receiving opening in the work surface must be cut with low tolerances, so that the holding element can be latched into the holding clamps.

BRIEF DESCRIPTION OF THE DRAWINGS

Identical or functionally equivalent elements are provided with the same reference numerals in all figures.

DETAILED DESCRIPTION

Figure 1:
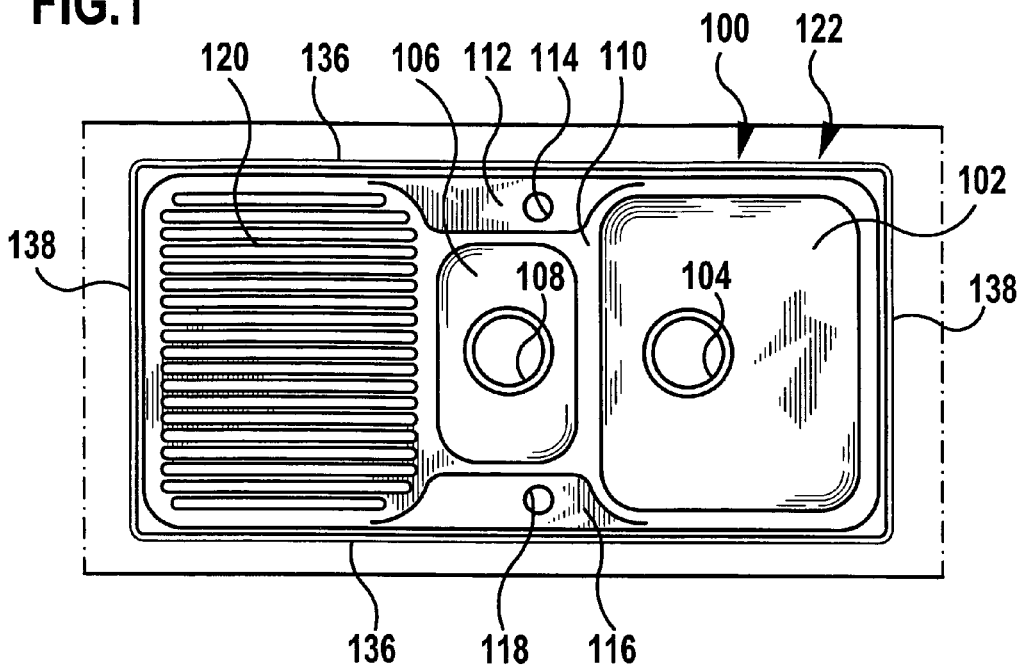
FIG. 1 is a schematic plan view from above onto an example sink unit, which is received in a receiving opening of a work surface.
Figure 2:
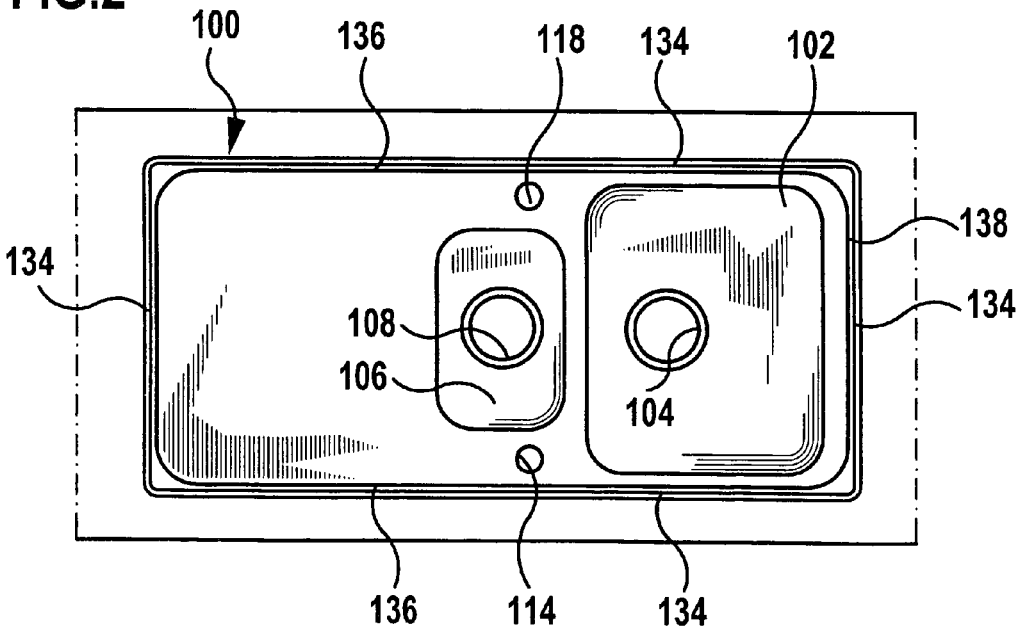
FIG. 2 is a schematic plan view from below onto the sink unit received in the receiving opening of the work surface.

An example sink unit shown in FIGS. 1 and 2 and given the overall reference 100 comprises a main basin 102 with a drain 104 and a waste basin 106 with a drain 108, which are arranged in a horizontal sink surface 110, as well as a rear fitting support surface 112 with a through hole 114 to receive a mixer tap unit (not shown), a front fitting support surface 116 with a through hole 118 to receive a cam to operate a drain plug and a drip surface 120 connecting to the waste basin 106 on the left.

The sink unit 100 is provided with a circumferential sink edge 122 (see FIG. 3), which comprises a horizontal sink edge face 123, which descends via an inner convexly curved region 124 and an inner slope 126 to the horizontal sink surface 110 and via an outer convexly curved region 128 and an outer slope 130 to an outer edge 132 of the sink unit 100.

The curved regions 128 and 124 are convexly curved in plan view from above onto the sink unit 100; these regions are therefore concavely curved in plan view from below onto the sink unit 100.

On the underside of the sink unit 100 several holding elements 134 are arranged, of which respectively one extends along the two long sides 136 and respectively one extends along the two short sides 138 of the substantially rectangular sink unit 100. Two holding elements 134 respectively terminate at a distance from one another in the rounded corner regions of the sink unit 100.

It can also be provided that each of the holding elements 134 running along a side of the sink unit 100 is divided into several spaced holding element sections.

Figure 3:
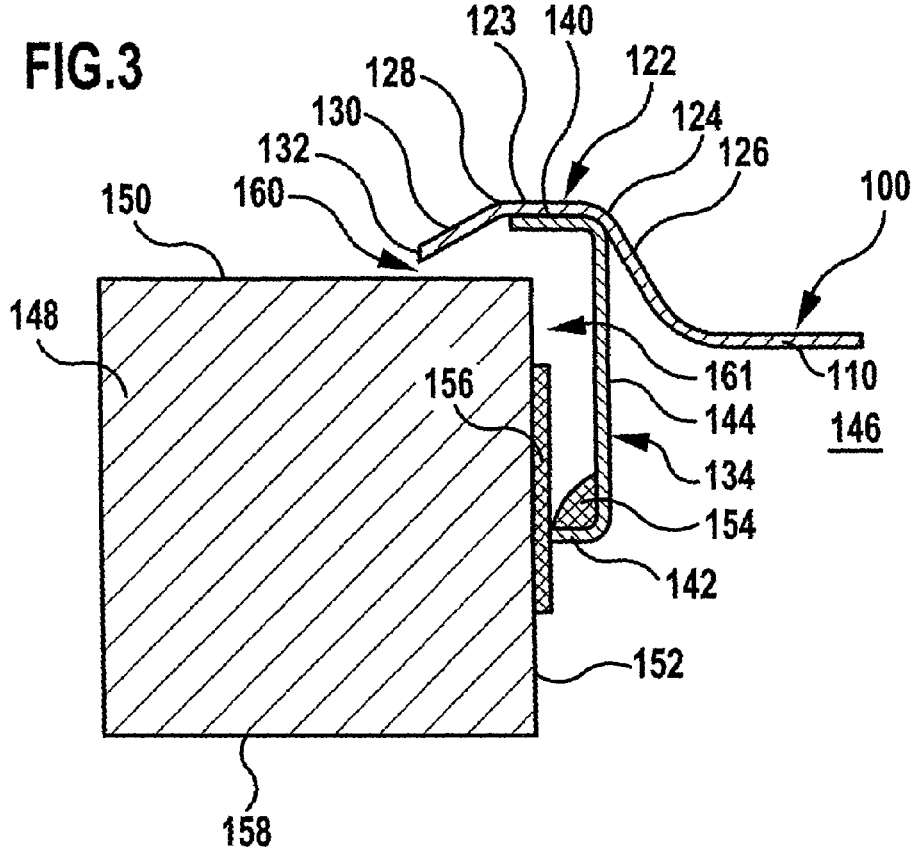
FIG. 3 is a schematic sectional view through the sink unit and a holding element fastened to its underside as well as an edge region of the work surface directly after a variable-volume material has been applied.

As may be seen from FIG. 3, each of these holding elements 134 has a generally C-shaped cross-section, with a horizontal upper leg 140, a horizontal lower leg 142, which as a result of the holding element 134 is slightly shorter in cross-section than the upper horizontal leg 140, and a vertical web 144 joining the lower leg 142 to the upper leg 140.

The upper leg 140 of the holding element 134 abuts flat against the underside of the horizontal sink edge region 123 with its upper side, wherein the transition area between the upper leg 140 and the vertical web 144 closely adjoins the underside of the inner convexly curved region 124 of the sink edge 122.

In this transition region, the holding element 134 is fastened to the sink unit 100 by welding, preferably by laser welding.

Alternatively or additionally to welding of the holding element 134 to the sink unit 100, it can also be provided that the holding element 134 is glued to the underside of the sink unit 100 by means of a suitable adhesive.

The sink unit 100 is provided to be received in a generally rectangular receiving opening 146 of a work surface 148, said opening having a substantially vertical cut face 152, which is directed perpendicular to the upper side 150 of the work surface 148 and which was produced by means of a compass saw, for example, and borders the receiving opening 146.

The fastening of the sink unit 100 to the work surface 148 is achieved by means of a variable-volume material, as described below with reference to FIGS. 3 to 5.

The variable-volume material used is a two-component polyurethane foam, for example, such as that marketed by Rampf Gieβharze GmbH & Co. KG, Albstraβe 37, 72661 Grafenberg, Germany under the name RAKU-PUR® 34 (in-house name: "Hartschaum 534").

In this case, one of the two components of the polyurethane foam contains the monomers to be cross-linked with one another and the other component contains an isocyanate hardener. The isocyanate hardener is overdosed therein in order to generate the two-stage expansion behaviour of the polyurethane foam described below.

The two components of the polyurethane foam are supplied and stored in separate receptacles and are applied simultaneously upon use of the polyurethane foam.

For this application a dispenser can be used, for example, which has a cylindrical exit nozzle, which is connected to a storage container for the first component, and a second exit nozzle surrounding this exit nozzle in a ring shape, which is connected to a storage container for the second component. By means of two interconnected plungers, which act on the first component and the second component, the first component and the second component of the polyurethane foam can be discharged simultaneously through the respective exit openings in a predetermined mixture ratio.

As may be seen from FIG. 3, a bead 154 of the variable-volume material is applied to the holding element 134 in the transition area between the lower leg 142 and the web 144.

A film 156 of the variable-volume material is additionally applied to the cut face 152 of the work surface 148, in which case the film 156 can be spaced both from the upper side 150 and from the underside 158 of the work surface 148.

The application of the bead 154 and the film 156 can be conducted over the entire length of the holding element 134 or only over part-sections of the holding element 134.

Directly after the application of the bead 154 and the film 156, the sink unit 100 is inserted into the receiving opening 146 of the work surface 148, wherein a gap 160 remains firstly between the outer edge 132 of the sink unit 100 on the one hand and the upper side 150 of the work surface 148 on the other hand (see FIG. 3). As may be additionally seen from FIG. 3, the thickness of the film 156 directly after application substantially corresponds to the distance of the lower leg 142 of the holding element 134 from the cut face 152.

The holding element 134 faces the work surface 148 with its legs 140, 142, so that an expansion chamber 161 is formed between the holding element 134 and the work surface 148 for a clamping body 162 to be formed from the variable-volume material.

In a first curing stage, the film 156 and the bead 154 of the variable-volume material expand until the film 156 and the bead 154 combine to form an intermediate body 164, which is integrally bonded both to the cut face 152 and to the holding element 134.

Figure 4:
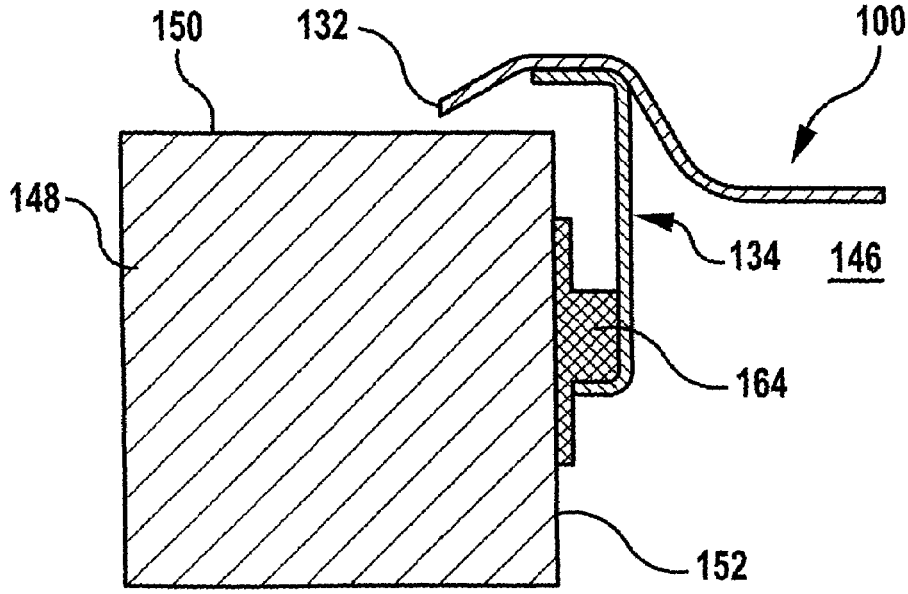
FIG. 4 is a sectional view corresponding to FIG. 3 after a first curing stage of the variable-volume material.

The state reached after this first curing phase (after a pot life of approximately 15 minutes, for example) is shown in FIG. 4. In this state the outer edge 132 of the sink unit 100 and the upper side 150 of the work surface 148 are still spaced from one another.

In a second expansion stage following this first curing phase, a so-called "dry expansion", which is effected, for example, by the presence of an excess of isocyanate hardener in a polyurethane foam used as variable-volume material, the intermediate body 164 expands further on all sides, which as a result of the integral bond already achieved in the first curing stage between the intermediate body 164 and the work surface 148, on the one hand, and the holding element 134, on the other, causes the clamping body 162 formed by full expansion of the intermediate body 164 to exert a compressive force on the upper side of the horizontal lower leg 140 (vertical compressive force $F_v$) and on the inside of the vertical web 144 of the holding element 134 (horizontal compressive force $F_h$).

The resultant of these compressive forces causes the holding element 134, and with it the sink unit 100, to which the holding element 134 is fastened, to be pulled downwards, so that the outer edge 132 of the sink unit 100 comes to abut against the upper side 150 of the work surface 148 and consequently the initially present gap 161 disappears.

The upper side of the upper leg 140 and the lower region of the inside of the web 144 of the holding element 134 thus form a lower contact surface 166 or an upper contact surface 167, at which the holding element 134 is subjected to a compressive force by the clamping body 162.

Because of the resultant total force acting on the holding element 134, the sink unit 100 is fastened to the edge region of the work surface 148 and can no longer be moved upwards out of the receiving opening 146.

In an alternative embodiment of the fastening of the sink unit 100 to the work surface 148, it can be provided that the dimensionally variable material is only applied to the holding element 134 and not to the cut face 152 of the work surface 148. In this case, the dimensionally variable material expands from the holding element 134 to the cut face 152 and there forms an integral bond with the work surface 148.

As already mentioned, the bead 154 and the film 156 can be applied circumferentially around the edge of the receiving opening 146 or only in sections.

Figure 6:
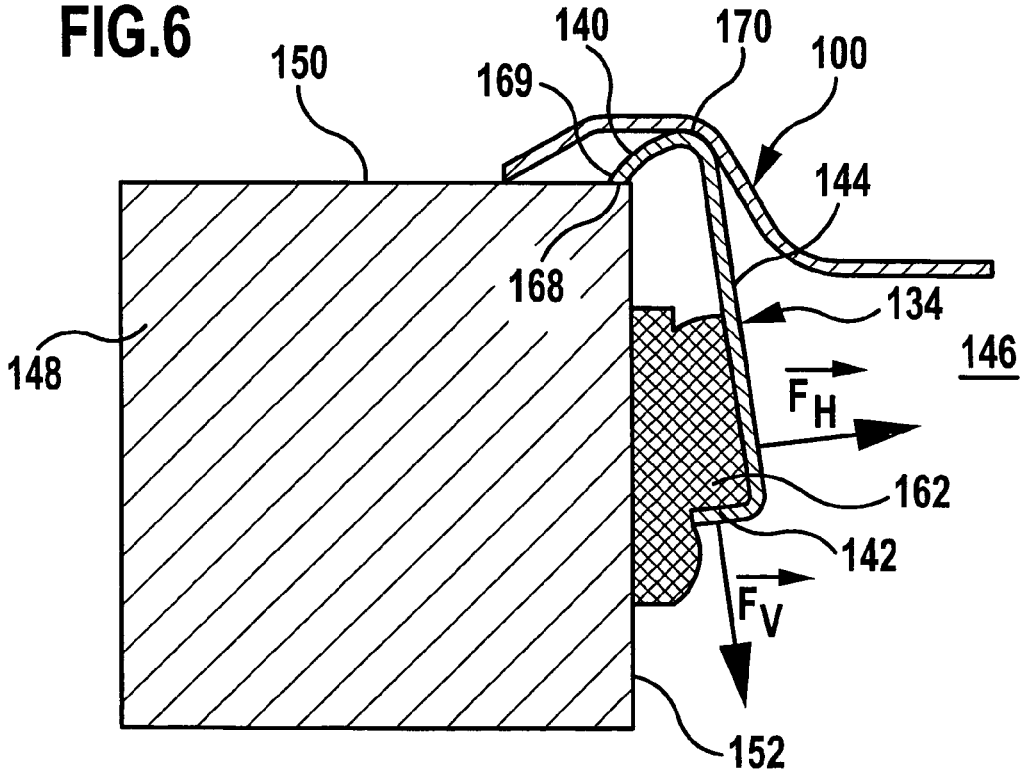
FIG. 6 is a schematic sectional view through an example sink unit with a holding element fastened to its underside, which has a torque stop, and an edge region of the work surface.

In the further embodiment of a fastening of the sink unit 100 to the work surface 148 shown in FIG. 6, the upper leg 140 of the holding element 134 is not straight, but convexly curved (viewed from its upper side 169).

In the state shown in FIG. 6, in which the clamping body 162 is fully expanded, the edge 168 of the upper leg 140 on the work surface side is thus supported on the upper side 150 of the work surface 148, and thus acts as a torque stop, which compensates the torque, which is exerted on the holding element 134 as a result of the compressive force $F_H$ from the clamping body 162 acting on the lower section of the inside of the web 144 of the holding element 134.

This torque is directed such that it endeavours to rotate the holding element 134 around the edge 170 between the upper leg 140 and the web 144, along which the holding element 134 is fastened to the underside of the sink unit 100 by welding (counter-clockwise as seen in the viewing direction of FIG. 6).

The counter-torque generated by the upper leg 140 acting as torque stop prevents the lower section of the holding element 134 from being bent still further into the interior of the receiving opening 146 than is shown in FIG. 6.

Otherwise, this further embodiment has the same structure and function as the embodiment explained above with reference to FIGS. 3 to 5.

Figure 5:
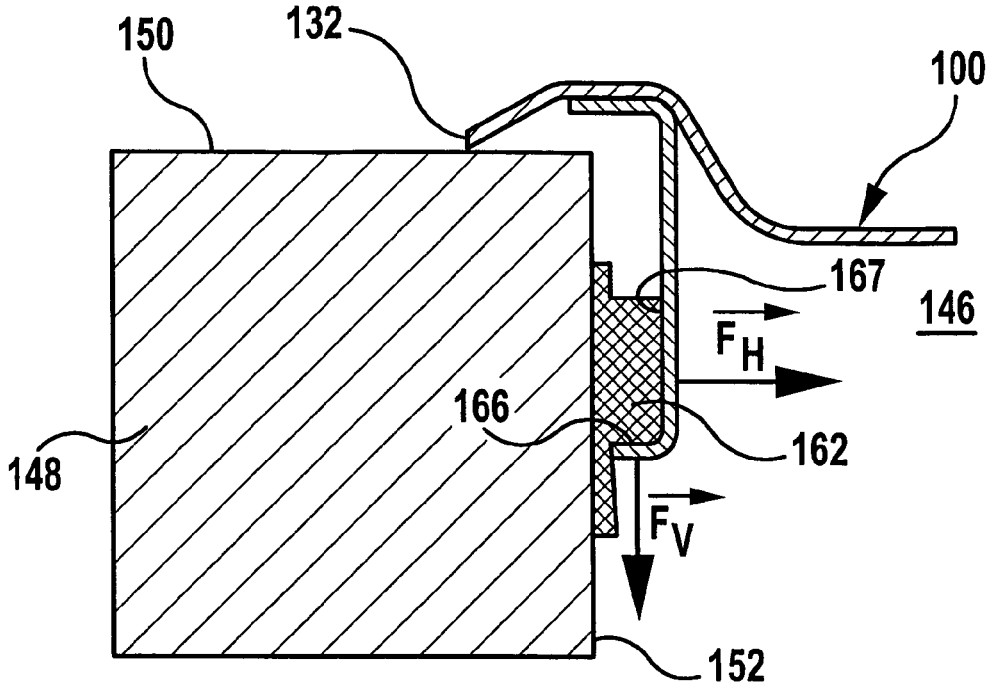
FIG. 5 is a sectional view corresponding to FIG. 3 after a dry expansion of the variable-volume material.
Figure 7:
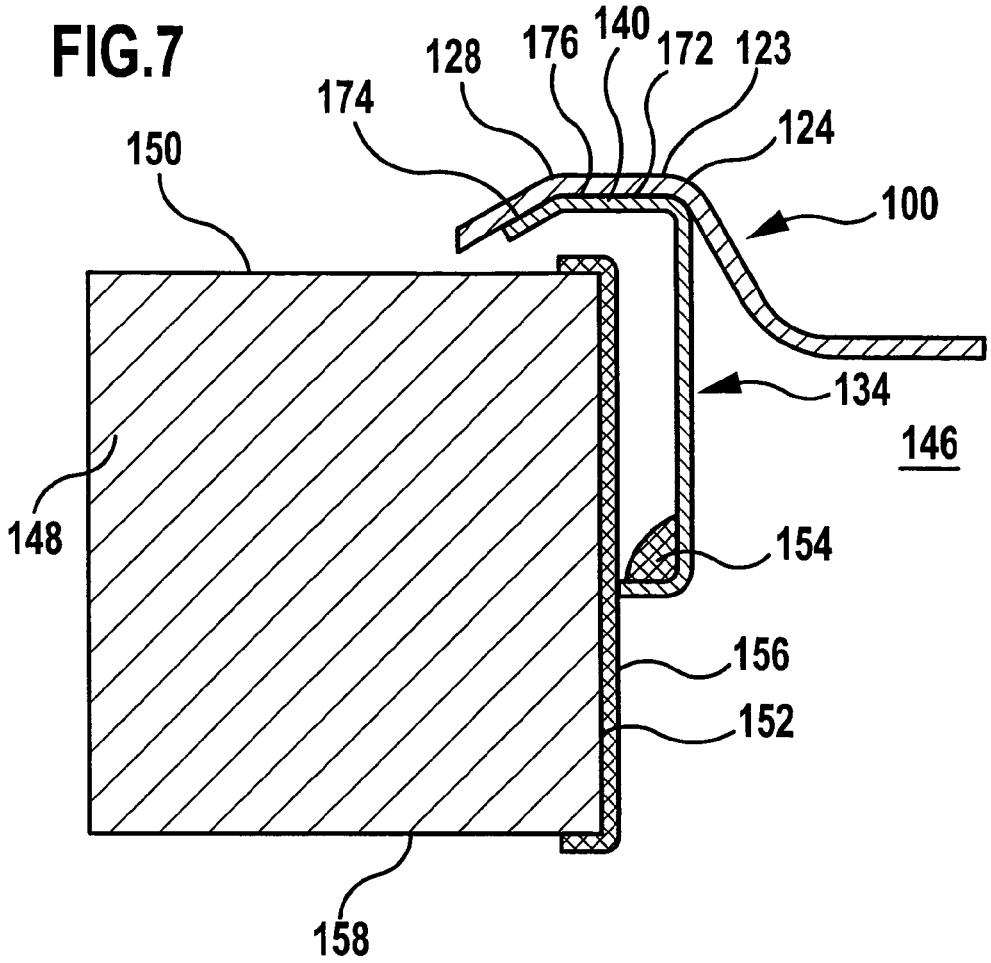
FIG. 7 is a schematic sectional view through an example sink unit with a holding element fastened thereto and an edge region of a work surface, wherein the edge of the work surface is sealed with a variable-volume material, directly after the variable-volume material has been applied.
Figure 8:
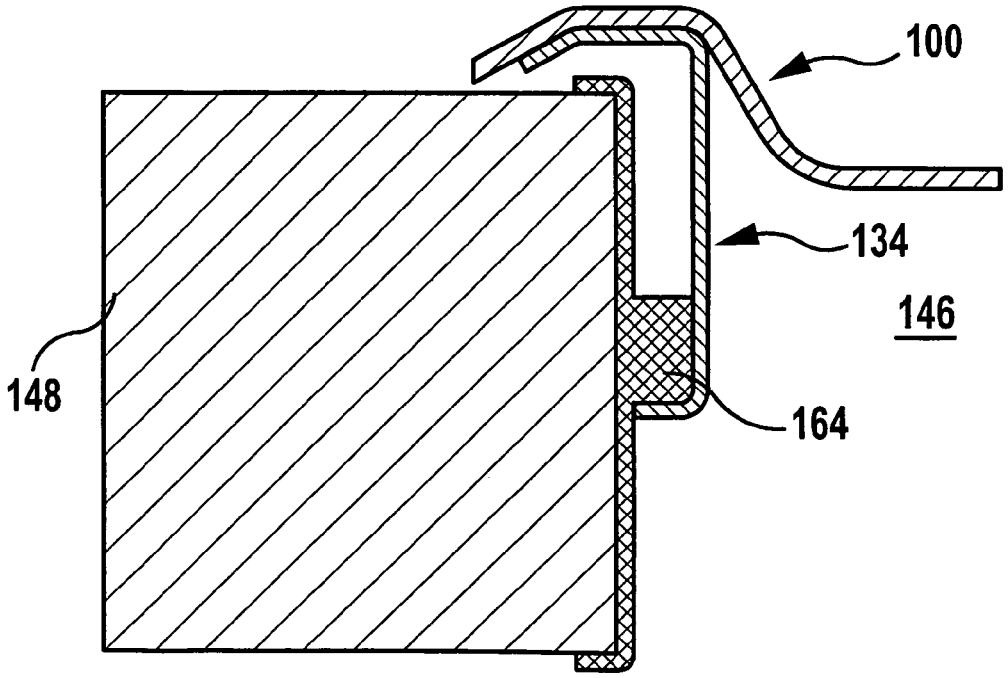
FIG. 8 is a sectional view corresponding to FIG. 7 after a first curing stage of the variable-volume material.
Figure 9:
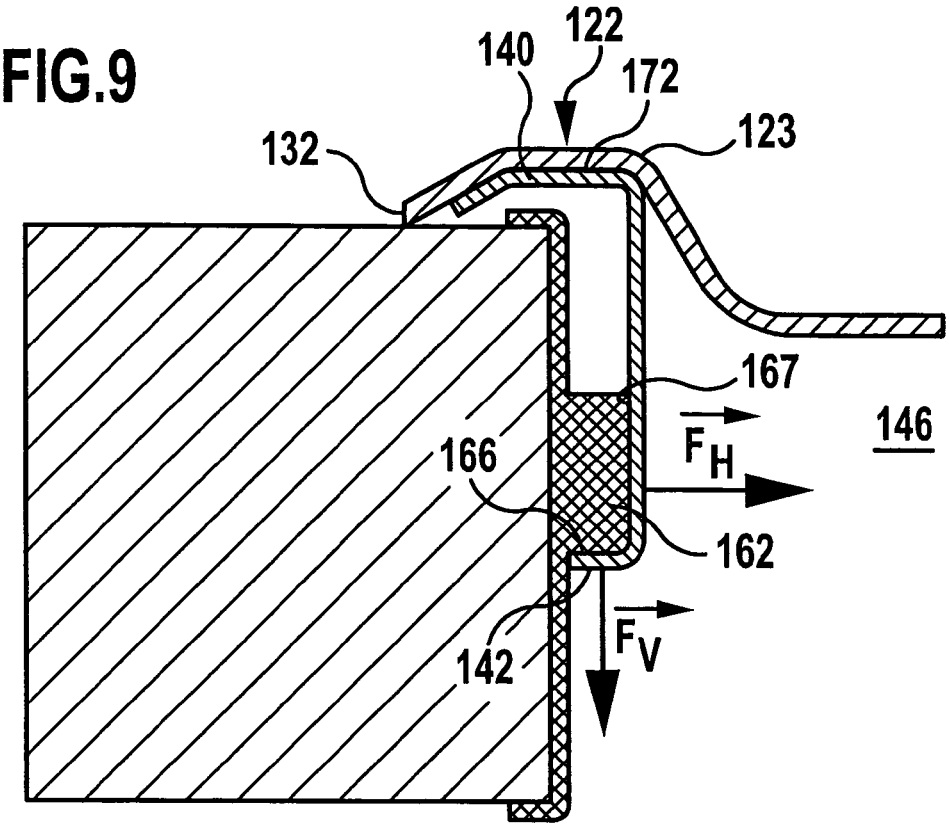
FIG. 9 is a sectional view corresponding to FIG. 7 after a dry expansion of the variable-volume material.

The embodiment of a fastening of the sink unit 100 to the work surface 148 shown in FIGS. 7 to 9 differs from the embodiment shown in FIGS. 3 to 5 in that besides a substantially horizontal section 172, the upper leg 140 of the holding element 134 also comprises a section 174 inclined towards the horizontal, which is joined to the edge of the horizontal section 172 on the work surface side via a (viewed from above) convexly curved transition section 176.

In this embodiment the holding element 134 is not fastened to the inner convexly curved region 124 of the sink unit 100 but instead is fastened by welding to the outer convexly curved region 128 of the sink edge 122 in the region of the convexly curved transition section 176.

As a result of the weld being shifted into the region of the outer convexly curved region 128 of the sink edge 122, the horizontal section 172 of the upper leg 140, which abuts flat against the underside of the horizontal sink edge region 123, forms a torque stop against a rotation of the holding element 134 (counter-clockwise as seen in the viewing direction of FIG. 7) around the convexly curved transition section 176, at which the holding element 134 is fastened to the sink unit 100.

Alternatively or additionally to a shift of the weld into the outer convexly curved region 128 of the sink edge 122, an additional support element could also be provided on the outside of the web 144 of the holding element 134 facing the sink unit 100.

In the fastening method shown in FIGS. 7 to 9, the film 156 of the variable-volume material is applied beyond the entire cut face 152 and the edges of the cut face 152 towards the upper side 150 and the underside 158 of the work surface 148, so that the cut face 152 of the work surface 148 is sealed by the dimensionally variable material and the work surface 148 (comprising a particle board, for example) is protected against the penetration of water from the cut face 152.

As a result, it is no longer necessary to additionally seal the cut face 152, e.g. by means of a silicone material. Instead, the same dimensionally variable material as used to form the clamping body 162 can be used for the sealing.

After application of the bead 154 and the film 156 and insertion of the sink unit 100 into the receiving opening 146, the film 156 and the bead 154 expand and combine to form the intermediate body 164 shown in FIG. 8, which is integrally bonded to the work surface 148 and the holding element 134.

As a result of a further "dry" expansion, the clamping body 162 shown in FIG. 9 is formed from this intermediate body 164, and this clamping body exerts a compressive force $F_v$ directed vertically downwards on the lower contact surface 166 of the holding element 134 and a horizontal compressive force $F_H$ directed into the interior of the receiving opening 146 on the upper contact surface 167 of the holding element 134.

The torque exerted on the holding element 134 through the horizontal compressive force is compensated by the horizontal section 172 of the upper leg 140 acting as a torque stop, which is supported on the horizontal sink edge region 123, while the vertical compressive force acting on the lower leg 142 pulls the holding element 134 and with it the sink edge 122 downwards, so that the outer edge 132 of the sink unit 100 comes into abutment against the upper side 150 of the work surface 148.

Otherwise, the embodiment shown in FIGS. 7 to 9 has the same structure and function as the embodiment illustrated above with reference to FIGS. 3 to 5.

Figure 10:
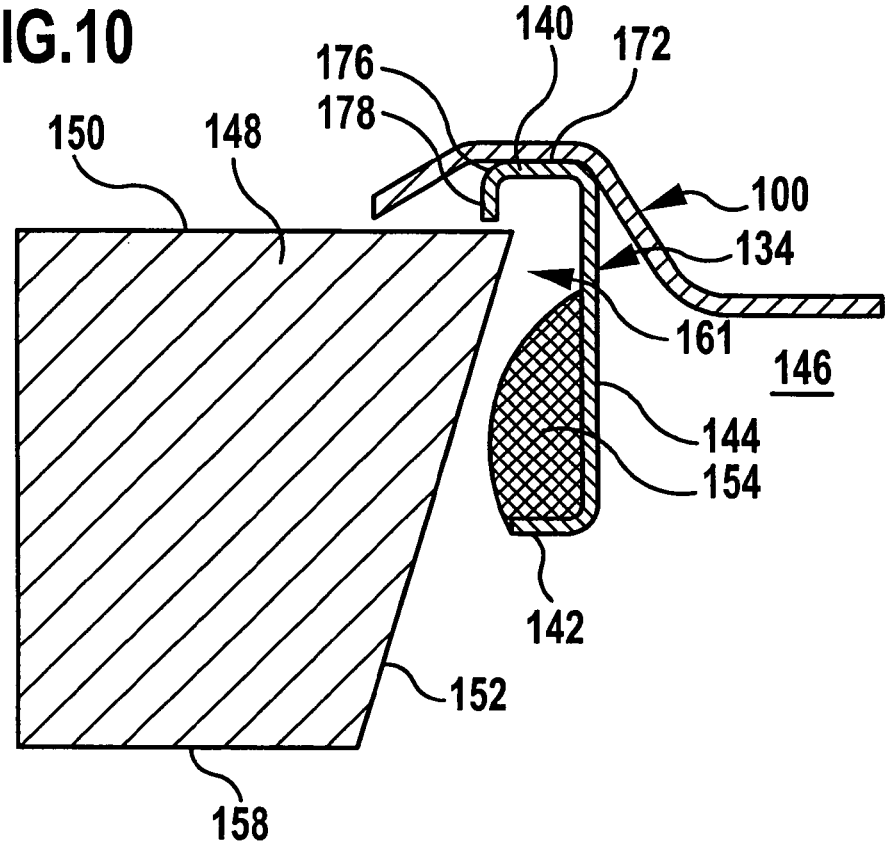
FIG. 10 is a schematic sectional view through an example sink unit with a holding element fastened to its underside and an edge region of a work surface, which has a sloping edge, directly after the variable-volume material has been applied.
Figure 11:
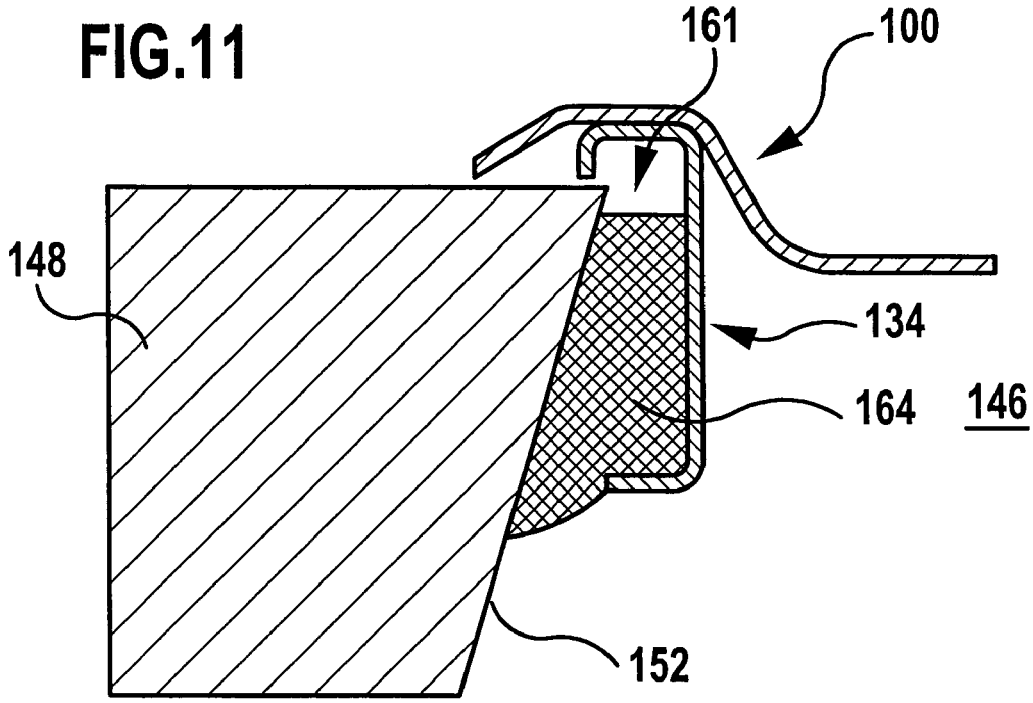
FIG. 11 is a sectional view corresponding to FIG. 10 after a first curing stage of the variable-volume material.
Figure 12:
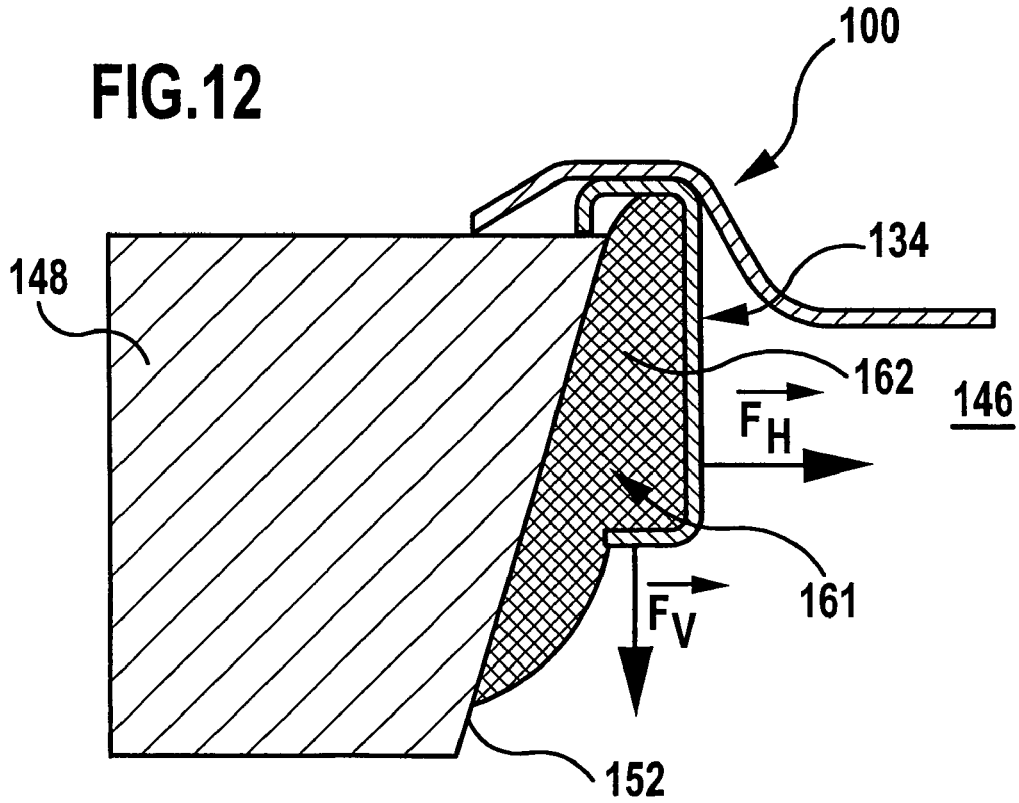
FIG. 12 is a sectional view corresponding to FIG. 10 after a dry expansion of the variable-volume material.

The further embodiment of a fastening of the sink unit 100 to the work surface 148 shown in FIGS. 10 to 12 differs from the embodiment shown in FIGS. 3 to 5 in that the cut face 152 of the work surface 148 does not run vertically, but is inclined towards the vertical such that the receiving opening 146 in the work surface 148 widens from the upper side 150 towards the underside 158 of the work surface 148.

Moreover, the amount of variable-volume material used is selected so that the expansion chamber 161 formed between the holding element 134 and the work surface 148 is filled to more than approximately 50% of its volume by the fully expanded clamping body 162 (see FIG. 12).

In order to prevent the variable-volume material from discharging upwards out of the expansion chamber 161 during its expansion, the holding element 134 comprises an upper leg 140 with a horizontal section 172, which merges via a convexly curved transition section 176 into a substantially vertical section 178, which is pulled towards the upper side 150 of the work surface 148 during the expansion of the clamping body 162, and thus closes off the expansion chamber 161 formed between the holding element 134 and the work surface 148 at its upper end.

In this embodiment, a bead 154 of the variable-volume material is applied to the upper side of the lower leg 142 and the inside of the web 144 of the holding element 134.

After insertion of the sink unit 100 into the receiving opening 146, the variable-volume material expands on curing until it comes into contact with the inclined cut face 152 of the work surface 148 and integrally bonds with this (see FIG. 11).

In the second "dry" expansion stage, the variable-volume material expands further until the clamping body 152 shown in FIG. 12 is formed, which fills the expansion chamber 161 almost completely.

Because an expansion chamber 161, which is filled to more than 50% of its volume by the clamping body 162, is provided in this embodiment, the structure of the clamping body 162 can be better controlled at least in its upper section than would be the case with a freely expanding foam.

Because the cut face 152 is inclined such that its normal is directed obliquely downwards, the resultant reaction force acting on the clamping body 162 from the work surface 148 is also directed downwards with the result that the horizontal compressive force $F_H$ acting on the inside of the web 144 decreases in favour of the vertical compressive force $F_v$ acting on the upper side of the lower leg 142 and therefore the resultant compressive force exerted on the holding element 134 by the clamping body 162 is directed more steeply downwards than in an embodiment, in which the cut face 152 is oriented vertically.

Therefore, an orientation of the cut face 152 inclined towards the vertical is of advantage in all embodiments of the fastening of the sink unit 100 to the work surface 148.

Otherwise, the embodiment shown in FIGS. 10 to 12 has the same structure and function as the embodiment described above with reference to FIGS. 3 to 5.

Figure 13:
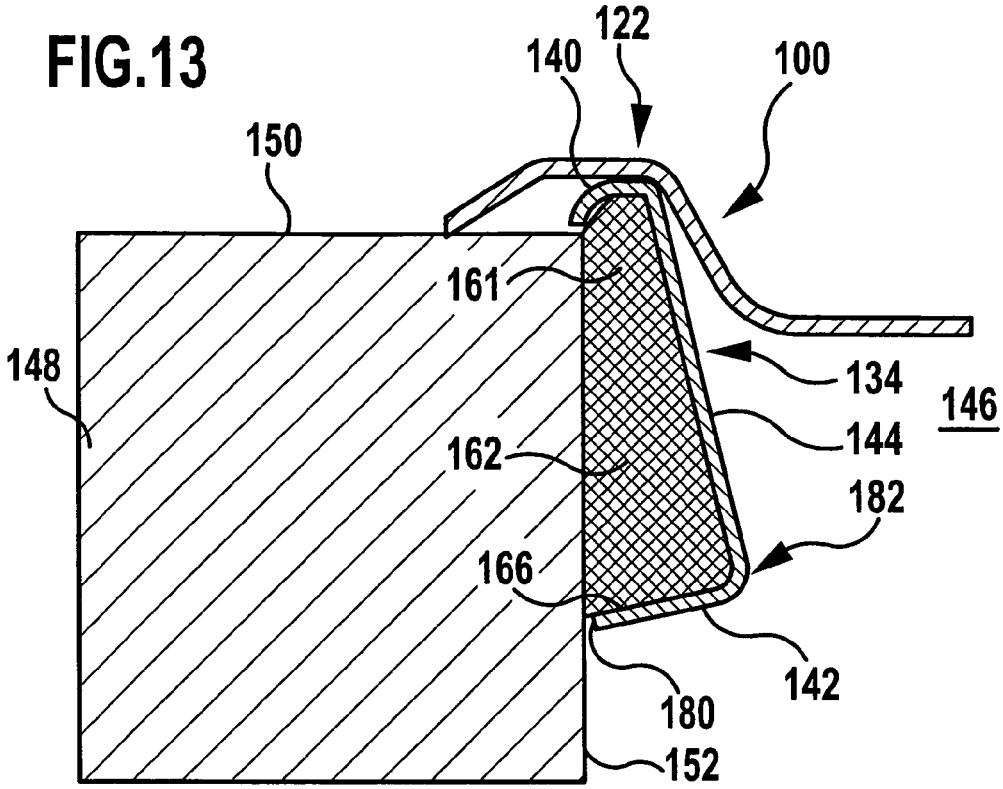
FIG. 13 is a schematic sectional view through an example sink unit with a holding element fastened to its underside, which has a lower contact surface inclined towards the horizontal, and an edge region of a work surface.

The embodiment of a fastening of the sink unit 100 to the work surface 148 shown in FIG. 13 differs from the embodiment shown in FIGS. 3 to 5 in that the web 144 of the holding element 134 is not oriented vertically, but is inclined towards the vertical such that the lower edge of the web is at a greater distance from the work surface 148 than the upper edge.

Moreover, the lower leg 142 of the holding element 134 is not horizontally oriented, but is inclined towards the horizontal such that its edge 180 on the work surface side lies at a lower level than the transition region to the web 144.

As a result of this structure of the holding element 134, the transition region between the web 144 and the lower leg 142 of the holding element 134 forms a lug 182 projecting into the interior of the receiving opening 146.

In this embodiment, the upper leg 140 of the holding element 134 is not straight, but is convexly curved (viewed from the upper side of the upper leg 140).

In this embodiment, the expansion chamber 161 configured between the holding element 134 and the work surface 148 is substantially completely filled by the fully expanded clamping body 162.

In this case, the circumstance that the lower contact surface 166 formed by the upper side of the lower leg 142 of the holding element 134 is clearly larger than the underside of the upper leg 140 ensures that the resultant compressive force exerted by the clamping body 162 on the holding element 134 is directed downwards and therefore pulls the sink edge 122 down towards the upper side of the work surface 148.

Otherwise, the embodiment shown in FIG. 13 has the same structure and function as the embodiment described above with reference to FIGS. 3 to 5.

Figure 14:
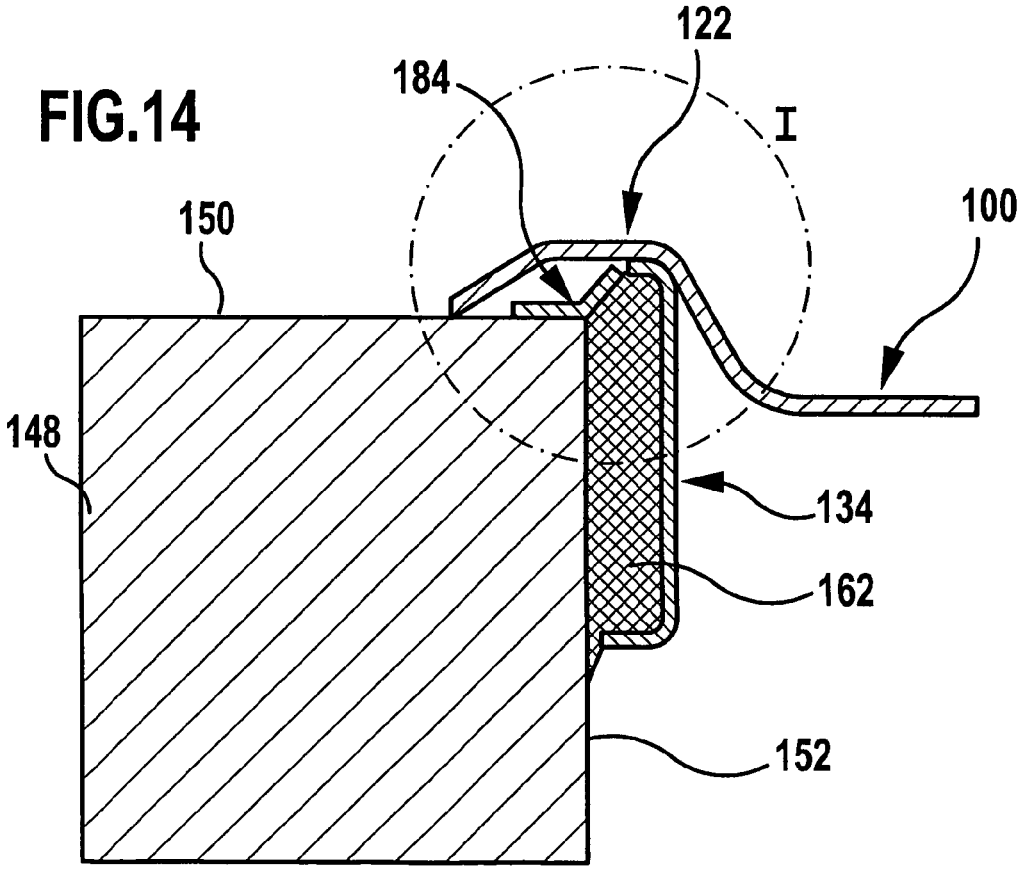
FIG. 14 is a schematic sectional view through an example sink unit with a holding element fastened to its underside and an edge region of a work surface, which is provided on its upper side with a support strip for a clamping body.
Figure 15:
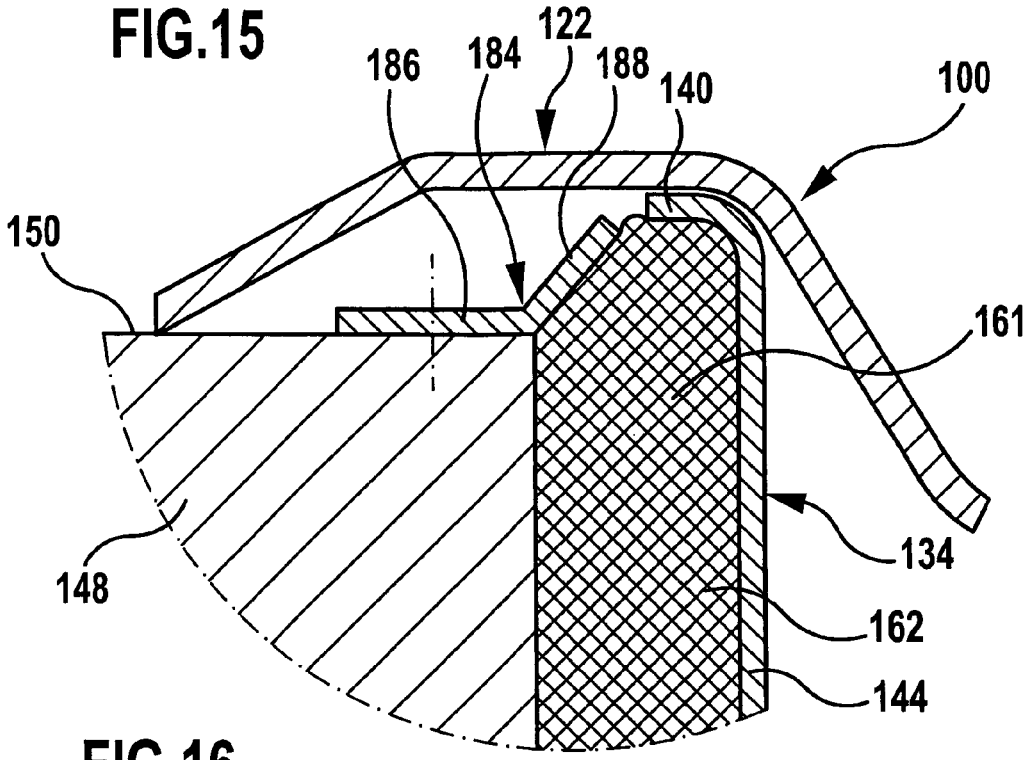
FIG. 15 is an-enlarged representation of region I in FIG. 14.

A further embodiment of a fastening of the sink unit 100 to the work surface 148 shown in FIGS. 14 to 15 differs from the embodiment shown in FIGS. 3 to 5 in that a support element in the form of a support strip 184 running along the edge of the receiving opening 146 is provided on the upper side 150 of the work surface 148.

The support strip 184 comprises a horizontal holding section 186, with which the support strip 184 is fastened to the upper side 150 of the work surface 148, e.g. by gluing and/or by means of screws or nails, and a support section 188 projecting obliquely upwards from the holding section 186 on the edge of the receiving opening 146.

In order to prevent a collision with the support section 188 of the support strip 184, the upper leg 140 of the holding element 134 is configured shorter in this embodiment than in the embodiment shown in FIGS. 3 to 5.

The holding element 134, the support strip 184 and the work surface 148 form an expansion chamber 161 between them, which is substantially completely filled by the fully expanded clamping body 162.

In the fully expanded state shown in FIGS. 14 and 15, the clamping body 162 is supported on the support section 188 of the support strip 184, which leads to a reaction force that is directed obliquely downwards acting on the clamping body 162 from the support strip 184.

This reaction force is transferred from the clamping body 162 to the holding element 134, which increases the vertically downward directed component of the compressive force exerted by the clamping body 162 on the holding element 134, so that the clamping force pulling the sink edge 122 towards the upper side 150 of the work surface 148 is increased.

In order to increase the reaction force acting on the clamping body 162 from the support section 188, it can be provided that the support strip 184 is provided with a spring element, which prestresses the support section 188 down towards the clamping body 162.

Otherwise, the embodiment shown in FIGS. 14 and 15 has the same structure and function as the embodiment illustrated above with reference to FIGS. 3 to 5.

Figure 16:
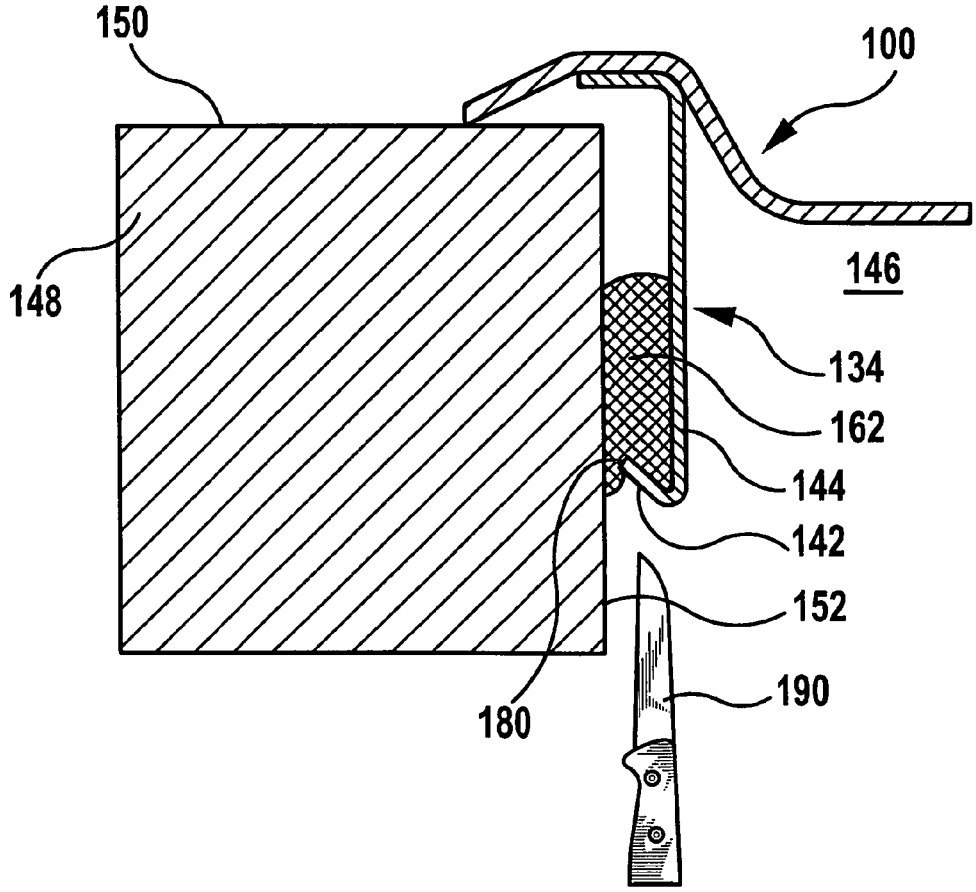
FIG. 16 is a schematic sectional view through an example sink unit with a holding element fastened to its underside, which has a blade guide, and an edge region of a work surface.
Figure 17:
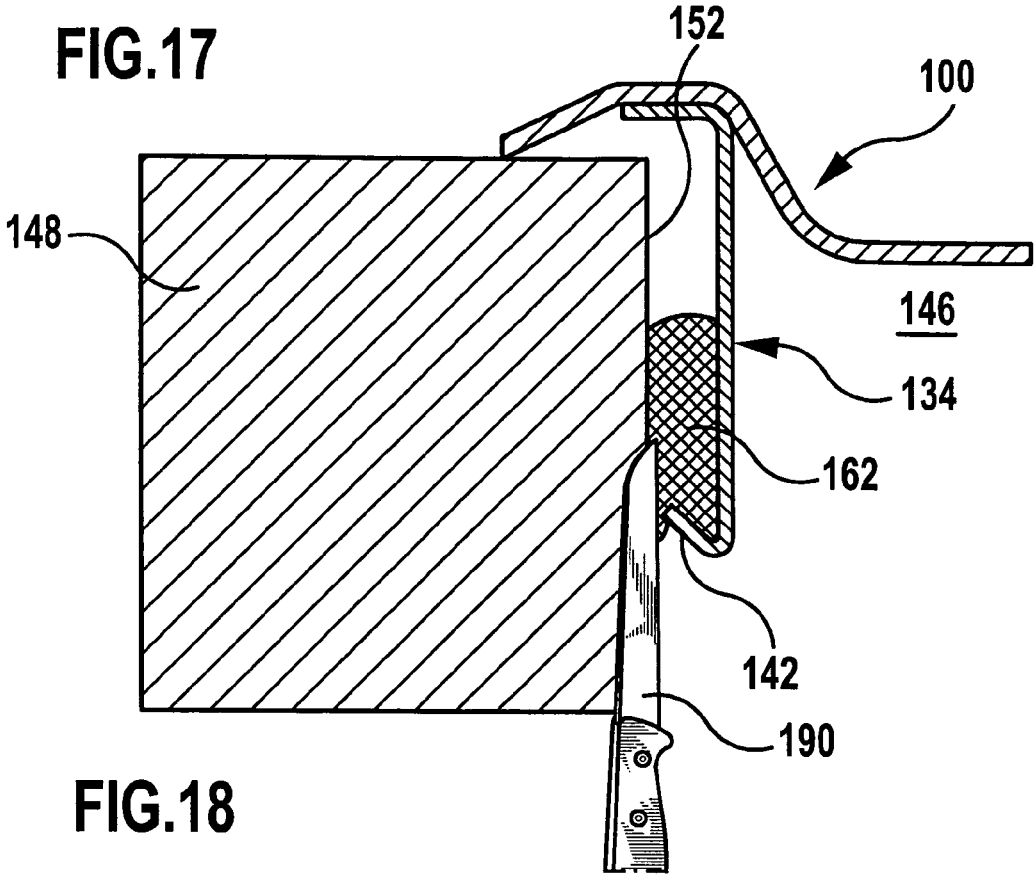
FIG. 17 is a sectional view corresponding to FIG. 16, during detachment of a clamping body from the work surface by means of a blade.
Figure 18:
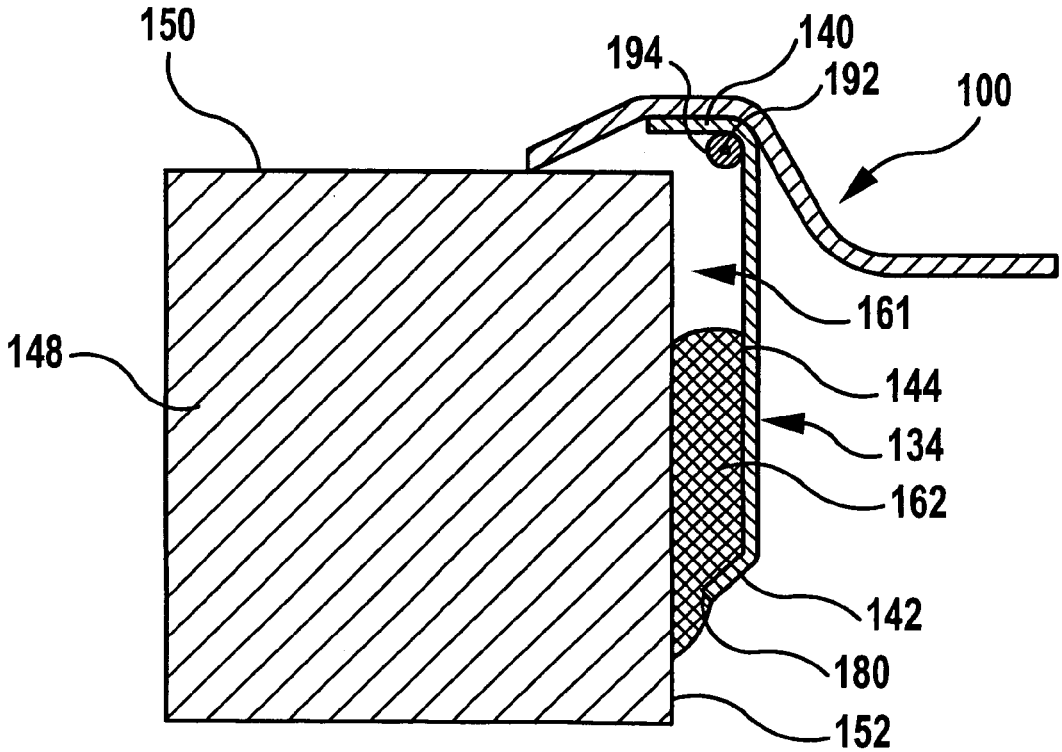
FIG. 18 is a schematic sectional view through an example sink unit with a holding element fastened to its underside, on which a separating element is arranged to cut through a clamping body, and an edge region of a work surface.

A further embodiment of a fastening of the sink unit 100 to the work surface 148 shown in FIGS. 16 to 17 differs from the embodiment shown in FIGS. 3 to 5 in that the lower leg 142 of the holding element 134 is not oriented substantially horizontally, but is oriented obliquely upwards, and that is in such a manner that the edge 180 of the lower leg 142 on the work surface side lies at a higher level than its edge remote from the work surface 148, at which the lower leg 142 merges into the web 144 of the holding element 134.

As a result of this configuration, the lower leg 142 forms a blade guide for a cutting blade 190, which is inserted from below into the gap between the edge 180 of the lower leg 142 on the work surface side, on one side, and the cut face 152 of the work surface 148, on the other side, and by means of said blade the clamping body 162 arranged between the cut face 152 and the holding element 134 can be cut through and/or detached from the work surface 148 in order to sever the connection between the holding element 134 and the work surface 148 and then the sink unit 100 can be lifted upwards out of the receiving opening 146.

The cutting blade 190 is guided on one side by the insertion slope formed by the lower leg 142 and on the other side by the straight cut face 152 for a cut running around the receiving opening 146.

Otherwise, the embodiment shown in FIGS. 16 and 17 has the same structure and function as the embodiment described above with reference to FIGS. 3 to 5.

An embodiment of a fastening of the sink unit 100 to the work surface 148 shown in FIGS. 18 to 21 differs from the embodiment shown in FIGS. 3 to 5 in that the lower leg 142 of the holding element 134 is not oriented horizontally but obliquely downwards, and that is in such a manner that the edge 180 of the lower leg 142 on the work surface side lies at a lower level than its edge remote from the work surface 148, at which the lower leg 142 merges into the web 144 of the holding element 134.

As a result of this structure of the lower leg 142, this serves as a guide for a separating element in the form of a metal wire 192, which is arranged in the expansion chamber 161 above the clamping body 162 and to cut through the clamping body 162 can be pulled down through the gap between the edge 180 of the lower leg 142 of the holding element 134 on the work surface side on one side and the cut face 152 of the work surface 148 on the other side.

The metal wire 192 extends in the longitudinal direction of the holding element 134 and is enclosed by a tubular sheath 194, which is made of paper, for example.

Before assembly of the sink unit 100 on the work surface 148, the sheath 194 containing the metal wire 192 is fastened to the transition region between the upper leg 140 and the web 144 of the holding element 134, e.g. by gluing.

Figures 19, 20, 21:
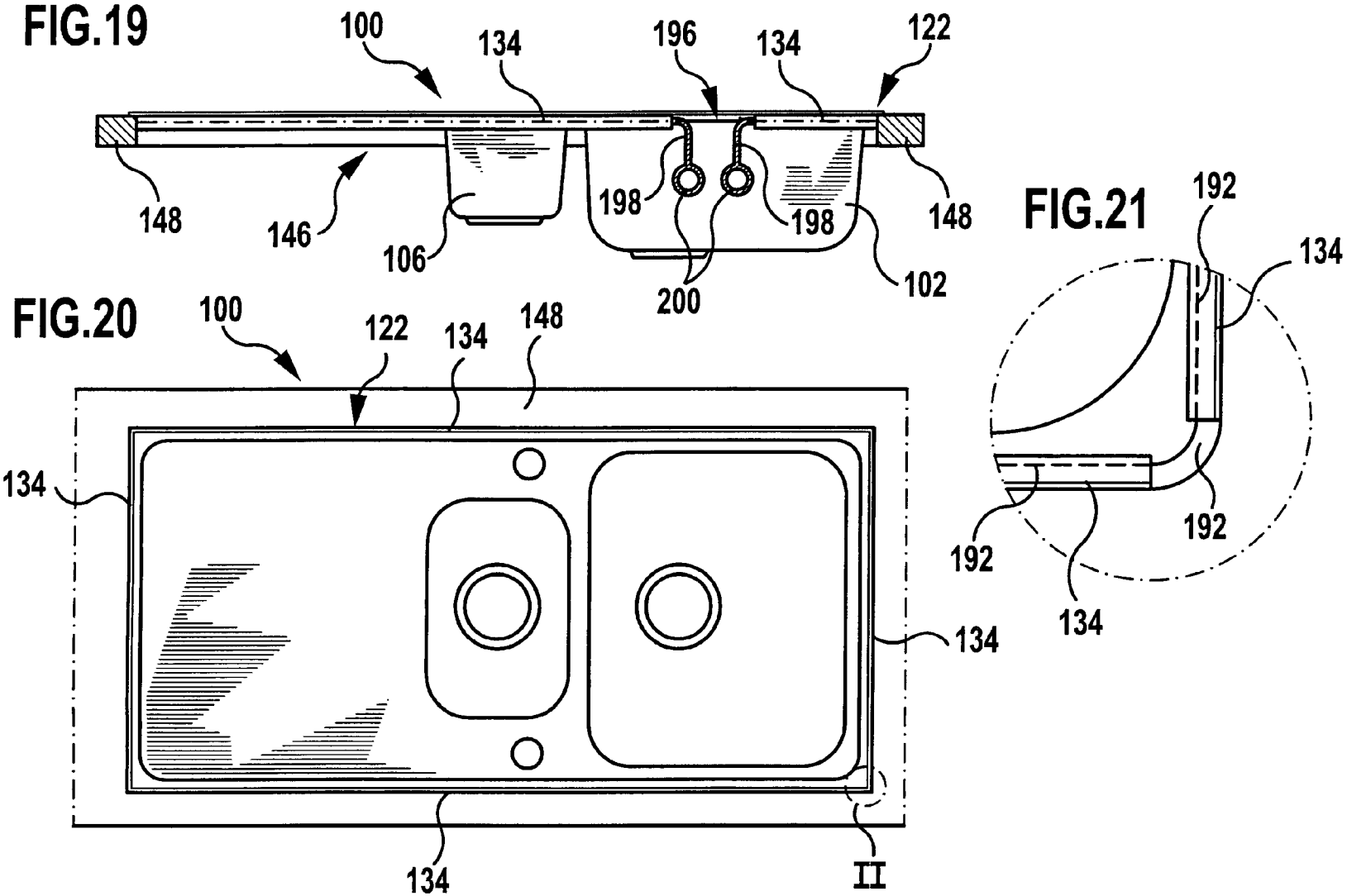
FIG. 19 is a schematic side view of an example sink unit arranged in a receiving opening of a work surface with operating handles to operate a separating element for cutting through a clamping body.
FIG. 20 is a schematic plan view from below onto the sink unit received in the receiving opening of the work surface from FIG. 19.
FIG. 21 is an enlarged representation of region II in FIG. 20.

As is shown in FIGS. 20 and 21, the separating element formed by the metal wire 192 runs around through all the holding elements 134 arranged on the sink edge 122, in which case at the corner regions of the sink edge 122 the separating element respectively exits from one holding element 134 and enters the adjacent holding element 134.

As may be seen from FIG. 19, one of the holding elements 134 is broken at one location 196, wherein on both sides of the break location 196 a respective end region 198 of the metal wire 192 exits from the holding element 134.

Each of the end regions 198 of the metal wire 192 is respectively provided with an operating element 200 in the form of a pull ring.

In order to cut through the clamping body 162, the end regions 198 of the metal wire 192 are pulled downwards by means of the operating elements 200, as a result of which the metal wire 192 breaks through its sheath 194 and cuts through the clamping body 162 from top to bottom, wherein the lower leg 142 of the holding element 134 serves as exit slope for the metal wire 192.

As a result of cutting through the clamping body 162, the connection between the work surface 148 and the holding element 134 is broken, so that the sink unit 100 can then be lifted up out of the receiving opening 146.

Otherwise, the embodiment shown in FIGS. 18 to 21 has the same structure and function as the embodiment described above with reference to FIGS. 3 to 5.

Figure 22:
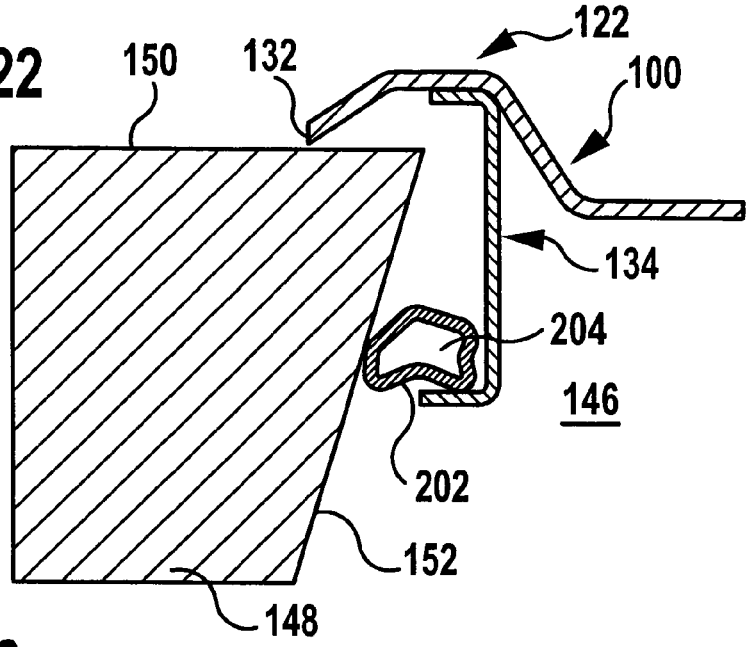
FIG. 22 is a schematic sectional view through an example sink unit with a holding element fastened to its underside, an edge region of a work surface, which has a sloped edge, and a variable-volume material enclosed by a flexible tube.
Figure 23:
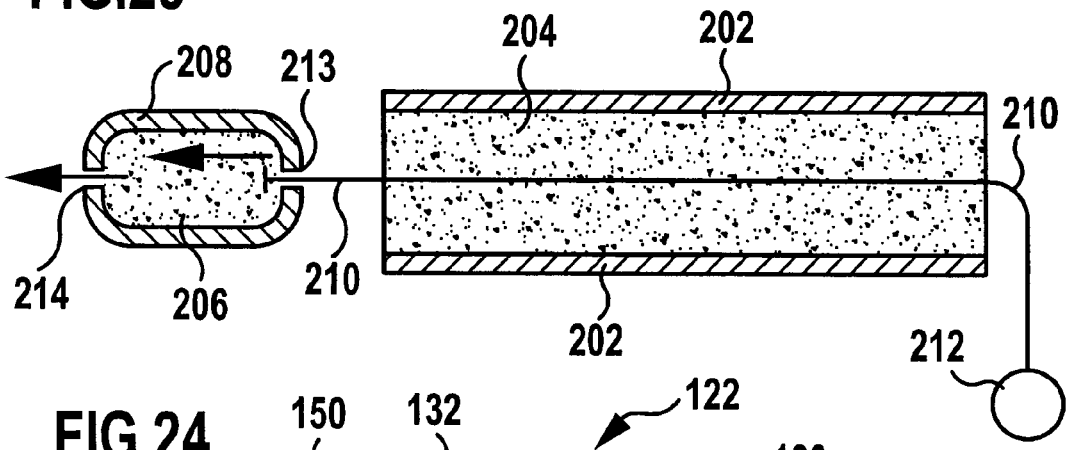
FIG. 23 is a schematic longitudinal section through a variable-volume material enclosed by a flexible tube and a capsule containing a hardener material, which can be passed through the tube.
Figure 24:
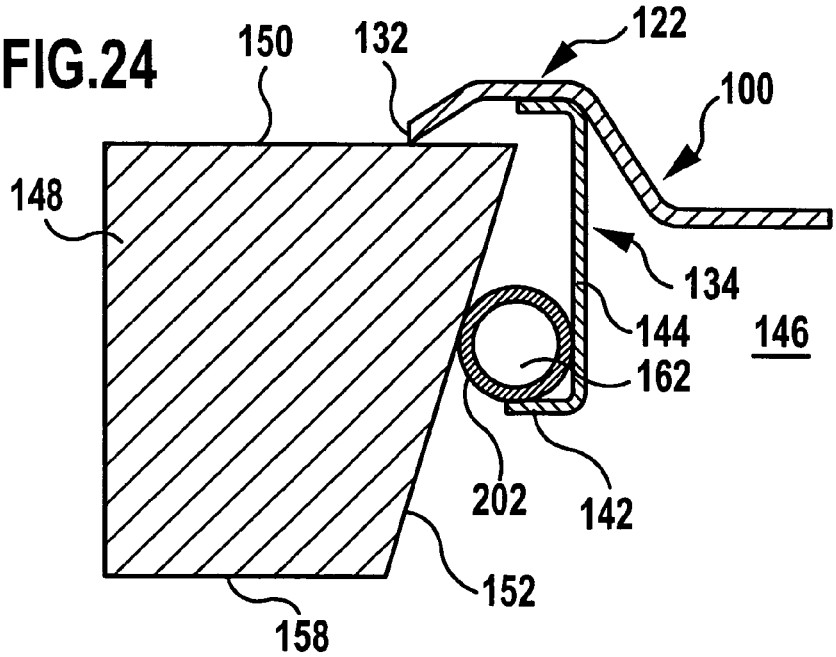
FIG. 24 is a sectional view corresponding to FIG. 22 after an expansion of the variable-volume material.

A further embodiment of a fastening of the sink unit 100 to the work surface 148 shown in FIGS. 22 to 24 differs from the embodiment shown in FIGS. 3 to 5 in that the variable-volume material is not applied directly onto the holding element 134 and/or the work surface 148, but is arranged instead in a flexible sheath 202 in the form of a tube.

The tube can be made of a plastic material, e.g. polyvinyl chloride.

As may be seen best from FIG. 23, a two-component foam is used in this embodiment, its first component 204 being arranged inside the flexible sheath 202.

The second component 206 is arranged inside a capsule 208, which is connected to an operating element 212 in the form of a pull ring by means of a pull cord 210, which is fastened to an end of the capsule 208.

The pull cord 210 is passed through the interior of the flexible sheath 202 of the first component 204, so that the capsule 208 can be pulled through the first component 204 of the variable-volume material contained in the flexible sheath 202 by pulling on the pull cord 210 by means of the operating element 212.

On the side of the capsule 208 lying at the front in pulling direction, an opening 213 is provided, through which a part of the first component 204 penetrates into the interior of the capsule 208 as the capsule 208 is pulled through the first component 204, and the second component 206 of the variable-volume material is displaced through an opening 214 in the capsule 208 located opposite the opening 213 and into the outer area of the capsule 208, where a curing reaction and therefore an expansion of the variable-volume material is activated by the contact between the first component 204 and the second component 206 of the variable-volume material, so that the variable-volume material expands to form the clamping body 162 with approximately circular cross-section shown in FIG. 24.

Upon this expansion the flexible sheath 202 becomes taut, so that it assumes the substantially cylindrical form shown in FIG. 24.

The fully expanded clamping body 162, which is supported on the cut face 152 of the work surface 148, exerts compressive forces on the inside of the web 144 and on the upper side of the lower leg 142 of the holding element 134, which form a resultant force, which is directed such that the holding element 134 is pulled downwards and the outer edge 132 of the sink edge 122 of the sink unit 100 comes into abutment against the upper side 150 of the work surface 148.

The cut face 152 of the work surface 148 is inclined towards the vertical such that the receiving opening 146 widens from the upper side 150 of the work surface 148 towards the underside 158 thereof. As a result, the normal of the cut face 152 of the work surface 148 is inclined downwards, and therefore the reaction force exerted by the work surface 148 on the clamping body 162 is also directed obliquely downwards. This increases the component of the compressive force directed vertically downwards, which the clamping element 162 exerts on the holding element 134.

The activation of the variable-volume material by operating the pull cord 210 occurs after the sink unit 100 has been inserted into the receiving opening 146 of the work surface 148.

Otherwise, the embodiment shown in FIGS. 22 to 24 has the same structure and function as the embodiment described above with reference to FIGS. 3 to 5.

Figure 25:
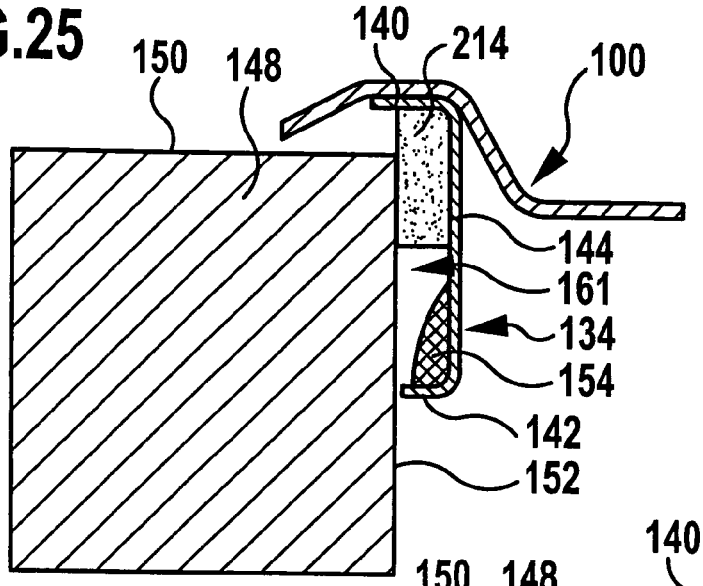
FIG. 25 is a schematic sectional view through an example sink unit with a holding element fastened to its underside, an expansion restricting body arranged on the holding element and an edge region of a work surface, directly after a variable-volume material has been applied.
Figure 26:
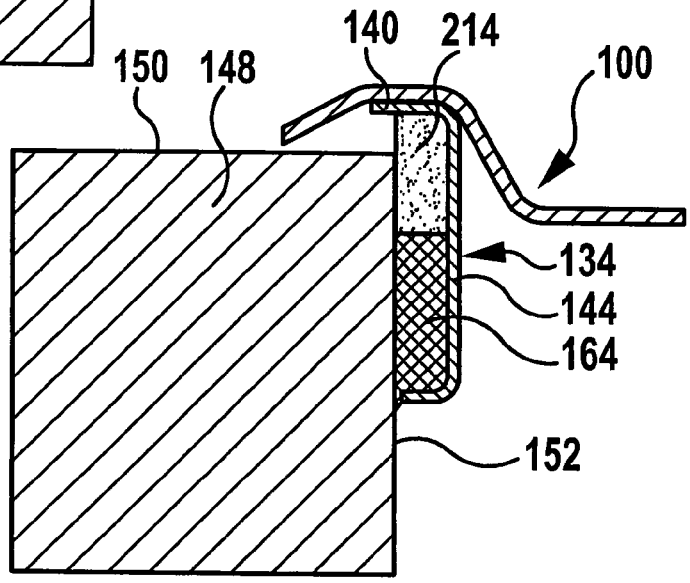
FIG. 26 is a sectional view corresponding to FIG. 25 after a first curing stage of the variable-volume material.
Figure 27:
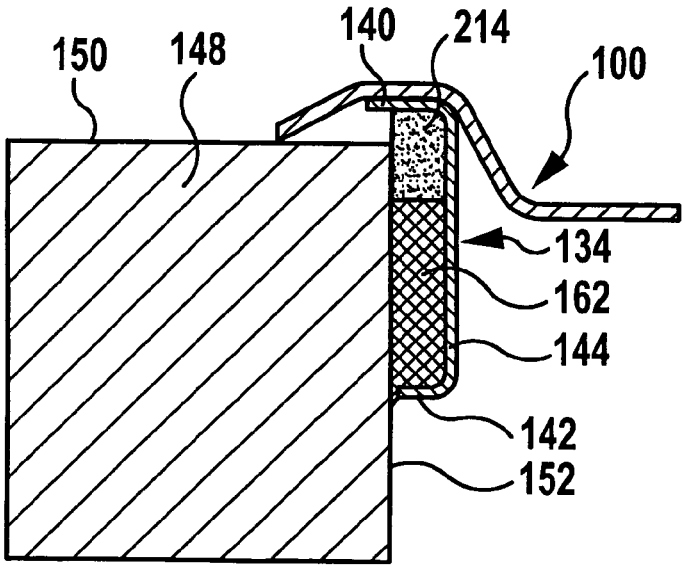
FIG. 27 is a sectional view corresponding to FIG. 25 after a dry expansion of the variable-volume material.

A further embodiment of a fastening of the sink unit 100 to the work surface 148 shown in FIGS. 25 to 27 differs from the embodiment shown in FIGS. 3 to 5 in that in the expansion chamber 161 formed between the holding element 134 and the work surface 148 an expansion restricting body 214 is arranged, which substantially covers the entire horizontal cross-section of the expansion chamber 161, and during the expansion of the variable-volume material applied to the holding element 134 in the form of a bead 154, is displaced with low reaction force by the expanding variable-volume material via the intermediate body 164 as far as the clamping body 162.

The expansion restricting body 214 prevents the variable-volume material from discharging upwards out of the expansion chamber 161.

Moreover, the expansion restricting body 214 prevents upwardly directed compressive forces from acting on the installation element 100.

Moreover, the upper boundary face of the clamping body 162 formed by the expansion is uniformly controlled, and therefore the structure of the clamping body 162 is better controlled.

The expansion restricting body 214 is preferably made of a material, which disintegrates or chemically decomposes upon contact with the variable-volume material, or which is substantially plastically deformed by the expanded variable-volume material without transferring compressive forces onto the upper leg 140 of the holding element 134.

For example, it can be provided that the expansion restricting body 214 is formed from polystyrene.

Before insertion of the sink unit 100 into the receiving opening 146 of the work surface 148, the expansion restricting body 214 is fastened to the underside of the upper leg 140 and/or to the inside of the web 144 of the holding element 134, e.g. by gluing.

Otherwise, the embodiment shown in FIGS. 25 to 27 has the same structure and function as the embodiment described above with reference to FIGS. 3 to 5.

A separating element, e.g. a metal wire, for cutting through the clamping body 162 for removal of the sink unit 100 from the receiving opening 146 of the work surface 148 can be embedded in the expansion restricting body 214 or arranged on the surface of the expansion restricting body 214.

Figure 28:
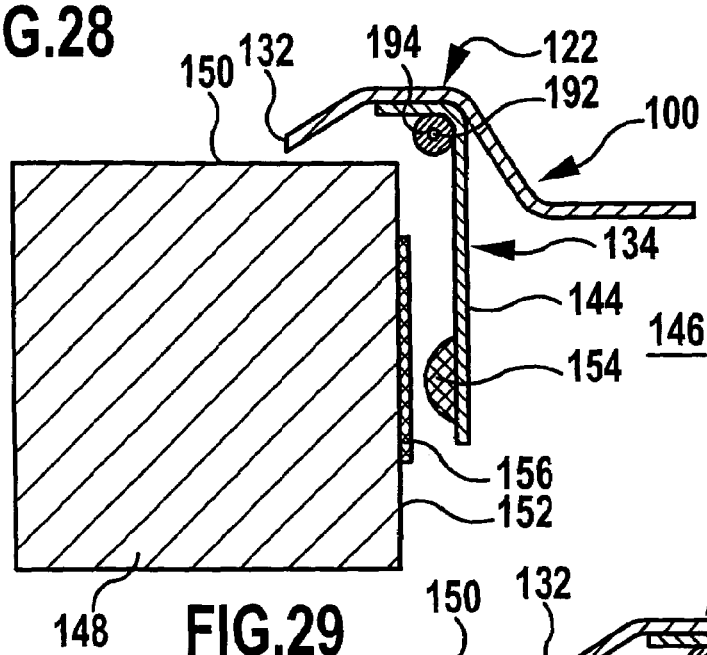
FIG. 28 is a schematic sectional view through an example sink unit with a holding element fastened to its underside, on which a separating element is arranged to cut through a clamping body, and an edge region of a work surface, directly after a variable-volume material has been applied.
Figure 29:
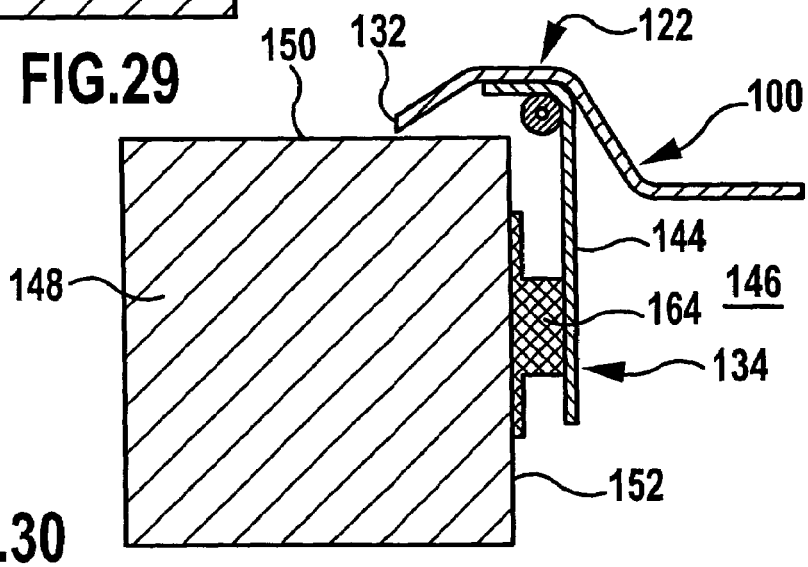
FIG. 29 is a sectional view corresponding to FIG. 28 after a first curing stage of the variable-volume material.
Figure 30:
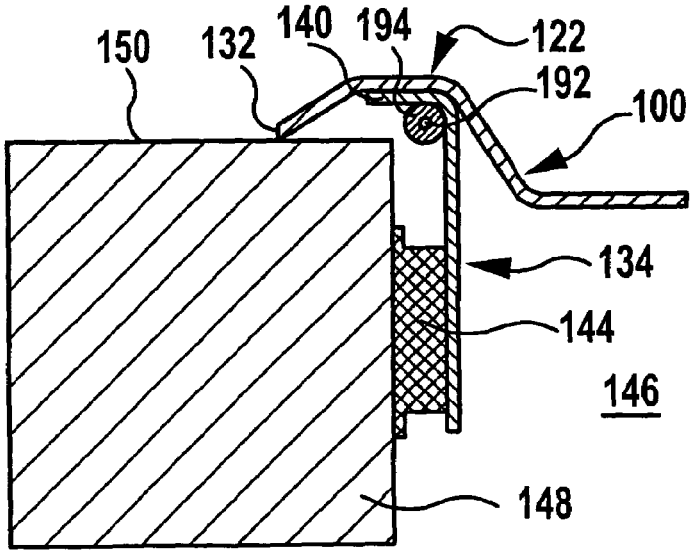
FIG. 30 is a sectional view corresponding to FIG. 28 after a dry expansion of the variable-volume material.

A further embodiment of a fastening of the sink unit 100 to the work surface 148 shown in FIGS. 28 to 30 differs from the embodiment shown in FIGS. 18 to 21 in that the holding element 134 of this embodiment does not have a lower leg 142.

The variable-volume material is applied in the form of a bead 154 onto the lower region of the inside of the web 144 of the generally L-shaped holding element 134 and in the form of a film 156 onto the cut face 152 of the work surface 148.

Directly after application of the variable-volume material, the sink unit 100 is inserted into the receiving opening 146 of the work surface 148.

In a first curing phase, the bead 154 and the film 156 expand until these combine to form an intermediate body 164, which is shown in FIG. 29, and is integrally bonded to the cut face 152 of the work surface 148 and to the web 144 of the holding element 134.

In the subsequent "dry" expansion phase the holding element 134 is pulled downwards, as a result of which the outer edge 132 of the sink edge 122 comes into abutment against the upper side 150 of the work surface 148.

The fastening of the sink unit 100 to the work surface 148 is thus concluded.

To release the sink unit 100 from the work surface 148 there serves, as in the embodiment shown in FIGS. 18 to 21, a separating element, e.g. in the form of a metal wire 192 provided with a tubular paper sheath 194, which extends along the holding element 134 and is fastened, e.g. by gluing, above the clamping body 162 to the upper leg 140 and/or to the web 144 of the holding element 134.

Otherwise, the embodiment shown in FIGS. 28 to 30 has the same structure and function as the embodiment described above with reference to FIGS. 18 to 21.

Figure 31:
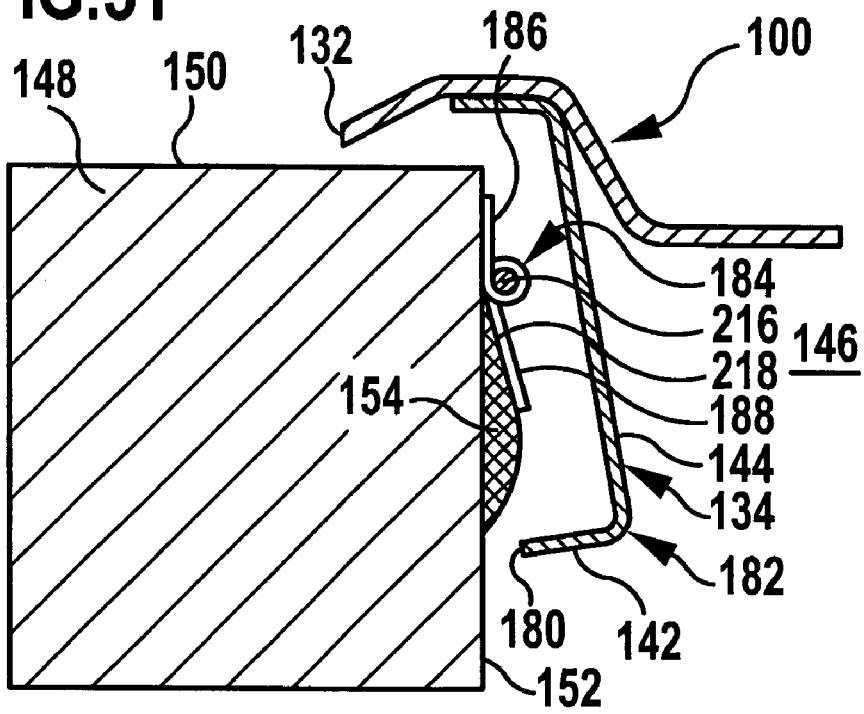
FIG. 31 is a schematic sectional view through an example sink unit with a holding element fastened to its underside, which has a lower contact surface inclined towards the horizontal, and an edge region of a work surface, wherein on the edge of the work surface a support strip prestressed by a spring is arranged to support a clamping body, directly after a variable-volume material has been applied.
Figure 32:
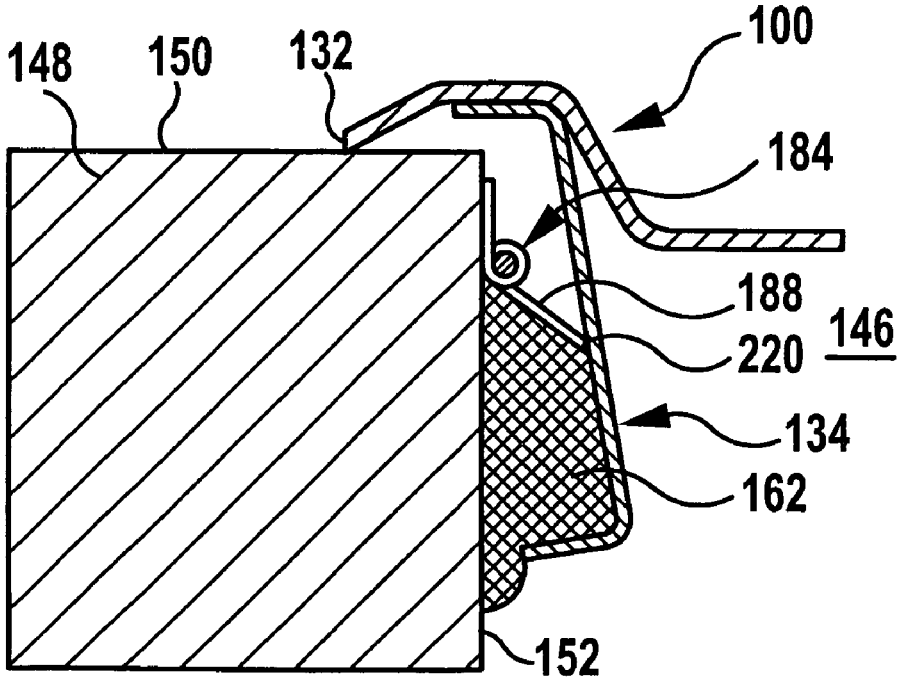
FIG. 32 is a sectional view corresponding to FIG. 31 after a dry expansion of the variable-volume material.

A further embodiment of a fastening of the sink unit 100 to the work surface 148 shown in FIGS. 31 and 32 differs from the embodiment shown in FIGS. 3 to 5 in that the web 144 of the holding element 134 is not oriented vertically, but is inclined towards the vertical, and that is in such a manner that a lower edge of the web 144 is at a greater distance from the cut face 152 of the work surface 148 than an upper edge thereof.

Moreover, the lower leg 142 of the holding element 134 is not oriented horizontally, but is inclined towards the horizontal, and that is in such a manner that an edge 180 of the lower leg 142 on the work surface side is arranged at a lower level than an edge of the lower leg 142 remote from the work surface 148, at which the lower leg 142 merges into the web 144.

As a result of this configuration of the web 144 and the lower leg 142, a lug 182 projecting into the interior of the receiving opening 146 is configured on the holding element 134 in the transition region of the web 144 and the lower leg 142.

Moreover, on the cut face 152 of the work surface 148 in this embodiment, a support strip 184 is arranged, which comprises an upper holding section 186, which abuts flat against the cut face 152 and is fastened to this—by gluing and/or by means of suitable fastening elements such as screws and/or nails, for example,—and also a support section 188, which projects obliquely downwards from the holding section 186 and which is pivoted to the holding section 186 via a hinge 216.

Moreover, a spring element 218 is provided on the support strip 184, which prestresses the support section 188 of the support strip 184 towards the cut face 152 of the work surface 148.

In this embodiment the variable-volume material is applied as a bead 154 between the face 152 and the support section 188 of the support strip 184.

Directly after the variable-volume material is applied, the sink unit 100 is inserted into the receiving opening 146 of the work surface 148, as shown in FIG. 31.

The variable-volume material then expands against the restoring force of the spring element 218 to form the clamping body 162 shown in FIG. 32, which exerts a resultant compressive force on the holding element 134, which causes the holding element 134 to be pulled downwards and the outer edge 132 of the sink unit 100 to come into abutment against the upper side 150 of the work surface 148.

In the fully expanded state of the clamping body 162, a free edge 220 of the support section 188 of the support strip 184 abuts against the inside of the web 144 of the holding element 134, so that the holding element 134 serves as a stop for the support section 188, which prevents the support section 188 from pivoting further upwards.

Therefore, in this stop position the support section 188 of the support strip 184 restricts the upward expansion of the clamping body 162.

Moreover, because of the restoring force of the spring element 218, the support section 188 exerts a compressive force on the clamping body 162, which is directed obliquely downwards towards cut face 152 of the work surface 148 and which causes the horizontal component of the compressive force exerted by the clamping body 162 on the holding element 134 to decrease and the component of the compressive force exerted by the clamping body 162 on the holding element 134 to increase.

Otherwise, the embodiment shown in FIGS. 31 and 32 has the same structure and function as the embodiment described above with reference to FIGS. 3 to 5.

From the foregoing, persons of ordinary skill in the art will readily appreciate that methods have been provided which enable an installation element to be fastened simply and quickly to a work surface.

An illustrated example method for fastening an installation element, in particular a sink, to the edge of a receiving opening for the installation element, wherein the installation element has at least one holding element, includes:

arranging a variable-volume material on the installation element and/or on the holding element and/or on the work surface and/or between the installation element and the work surface;

arranging the installation element in the receiving opening of the work surface;

changing the volume of the variable-volume material, so that a clamping body is formed from the variable-volume material, which exerts a resultant force on the holding element of the installation element, which causes the installation element to be pulled towards the work surface.

Arranging the variable-volume material on the installation element, on the holding element and/or on the work surface and/or between the installation element and the work surface, on the one hand, and arranging the installation element in the receiving opening of the work surface, on the other hand, can be conducted therein in any desired sequence.

In particular it is also conceivable that part of the variable-volume material is arranged on the installation element, on the holding element and/or on the work surface, that the installation element is then arranged in the receiving opening of the work surface, and that a further part of the variable-volume material is then arranged on the installation element, on the holding element and/or on the work surface and/or between the installation element and the work surface.

The holding element can be configured in one piece with the installation element, or alternatively thereto can be configured as a separate part from the installation element that is joined to the installation element.

A "variable-volume material" is understood in this description and the attached claims to be a material, which undergoes directly or indirectly, in particular by chemical reaction, a preferably irreversible change in volume, which is greater than a thermal expansion of the material possibly occurring as a result of a change in the ambient temperature.

A disclosed example solution is based on the concept, wherein the holding element joined to the installation element is not latched to a holding clamp arranged on the edge of the receiving opening, but instead a clamping body is formed from the variable-volume material, which exerts a downwardly directed resultant force on the holding element, which clamps the installation element to the work surface.

The clamping body is preferably a solid body, so that it can transfer compressive, shearing and/or tensile forces onto the holding element.

This concept has the advantage that the outer edge of the installation element can lie on the work surface substantially without any gap or at least with a slight gap, since the vertical distances that can be achieved between the installation element and the work surface are not predetermined by distinct latching steps.

Moreover, the final structure of the clamping body is not yet determined before the change in volume of the variable-volume material, and therefore the clamping body can adapt to the respective local distance between the edge of the work surface, on the one hand, and the holding element, on the other, and in this way cutting tolerances of the receiving opening of the work surface can be compensated.

In addition, this concept has the advantage that no holding clamps or similar fastening elements need to be prefabricated and fastened to the edge of the receiving opening before the installation element is arranged in the receiving opening.

Moreover, automatic centring of the installation element in the receiving opening can be achieved when the variable-volume material expands uniformly.

If the variable-volume material is arranged on the installation element and/or on the holding element and/or on the work surface before arranging the installation element in the receiving opening of the work surface, then the entire assembly of the installation element on the work surface can be conducted from above the work surface without it being necessary for the installer to enter the space below the work surface to perform one or more assembly steps.

If a holding element is used, which is not configured in one piece with the installation element, then the holding element is advantageously fastened to the installation element before arrangement of the variable-volume material.

In a preferred configuration, an expandable material is used as variable-volume material. By allowing the expandable material to expand a clamping body is formed from the expandable material, which exerts a resultant compressive force on the holding element of the installation element, which causes the installation element to be pulled towards the work surface.

A foamable material can used in particular as expandable material.

Such a foamable material can contain constituents, for example, which discharge gas and thus cause expansion of the material.

In particular, the foamable material can contain microspheres, which are filled with such gas-discharging constituents and increase in volume during the gas discharge until they reach their final volume.

In a preferred configuration, a plastic foam, preferably a two-component plastic foam, in particular a two-component polyurethane foam, is used as foamable material.

A suitable 2-component polyurethane foam is, for example, the hard foam marketed under the name RAKUPUR® 34 of Rampf Gießharze GmbH & Co. KG, Albstraße 37, 72661 Grafenberg, Germany.

In particular, it can be provided that the expandable material expands to its final volume in at least two consecutive stages.

Such a two-stage expansion can be effected, for example, by overdosing a hardener component in relation to a component of the expandable material to be cured.

In this case, it can be provided that in a first expansion stage, the expandable material forms an integral bond with the work surface and/or with the holding element.

In addition, it can be provided that the clamping body is bonded integrally and/or positively with the work surface and/or with the holding element. The transfer of compressive and/or tensile forces from the clamping body to the holding element is facilitated by the adhesion of the clamping body to the holding element. Similarly, the transfer of reaction forces from the work surface to the clamping body is facilitated by the adhesion of the clamping body to the work surface.

In a particular configuration of a disclosed example method, it is provided that a cut face of the work surface facing the receiving opening for the installation element is sealed by the clamping body. The work surface is often configured as a particle board and is thus sensitive to moisture. Because the cut face of the work surface is sealed by means of the variable-volume material there is no necessity to seal the cut face of the work surface against the penetration of water from the receiving opening into the work surface in an additional work cycle using a separate sealing material, e.g. a silicone material.

In order to apply the force from the clamping body to the holding element necessary to clamp the installation element on the work surface, a holding element is advantageously used that has a contact surface, which is subjected by the clamping body to a compressive force, which has a downwardly directed component.

In the assembled state of the installation element, this contact surface can be oriented substantially horizontally or be inclined towards the horizontal.

A particularly favourable transfer of compressive forces from the clamping body to the holding element is achieved, if a holding element is used that has a contact surface, of which the edge on the work surface side lies at a lower level than the edge remote from the work surface in the assembled state of the installation element.

To achieve an effective support of the holding element on the installation element, a holding element is advantageously used, which abuts flat against the underside of the installation element. This is particularly advantageous if the abutment of the holding element enables support of the introduced torque or tensile forces.

In particular, it can be provided that the holding element abuts against a sloping edge of the installation element.

The holding element can be welded and/or glued onto the installation element.

In order to prevent excessive tilting or deformation of the holding element as a result of forces acting in horizontal direction on the holding element, a holding element can be used, which has a support, which is supported on the work surface when the holding element is subjected by the clamping body to a force directed in horizontal direction into the interior of the receiving opening.

The holding element is advantageously fastened to the installation element in the region of a bend line, and is preferably welded to the installation element.

In particular it can be provided that the holding element is fastened, preferably welded, to the installation element in the region of a bend line between a sloping edge and a substantially horizontal edge region of the installation element.

It is particularly advantageous if a holding element is used, which comprises a leg with a section pointing towards the work surface, and the holding element is fastened, preferably welded, to the installation element in the region of this section. Advantageous leverage and moment ratios are achieved as a result of this.

To enable the final structure of the clamping body to be predetermined as accurately as possible, it can be provided that the clamping body partially fills an expansion chamber defined on one side by the holding element and on the other side by the work surface, preferably to approximately 50% to approximately 90% of the volume of the expansion chamber.

In order to prevent penetration of the variable-volume material into the edge region of the installation element, which lies on the work surface, it can be provided that the variable-volume material expands in an expansion chamber defined on one side by the holding element and on the other side by the work surface, wherein an upper end of the expansion chamber is closed off by the holding element abutting against the work surface.

The receiving opening can be produced particularly easily if it is provided that an edge face of the work surface defining the receiving opening is oriented substantially vertically.

However, in order to generate a compressive force on the holding element, which has as large as possible a component directed vertically downwards, it can be advantageous if the edge face of the work surface defining the receiving opening is inclined towards the vertical, at least in sections.

To reduce the compressive force component acting on the holding element in horizontal direction and to increase the compressive force component acting downwards on the holding element, it is particularly favourable if the edge face of the work surface is inclined towards the vertical such that the receiving opening widens downwards.

The compressive force exerted by the clamping body on the holding element can be further increased by a support element being fastened to the work surface, against which the clamping body is supported.

In particular, it can be provided that the support element subjects the clamping body to a compressive force directed perpendicularly or obliquely downwards.

It is additionally favourable if the support element has a section projecting out from the work surface obliquely to a surface of the work surface.

The support element can be arranged in particular on the upper side or on the edge face of the work surface defining the receiving opening.

The support element can be configured, for example, as a plastic strip, which is attached on insertion of the installation element.

Alternatively or additionally hereto, a support element can be used that has a hinge, which is preferably prestressed towards the clamping body by means of a spring element.

To be able to release the installation element from the work surface again in a simple manner, it can be provided that a holding element is used, which is provided, preferably on its lower end, with a guide element for a cutting blade.

The guide element preferably has an insertion slope for the cutting blade to allow easy insertion of the cutting blade at a defined position.

After assembly of the installation element on the work surface, the clamping body can then be cut through and/or detached from the work surface or from the holding element by means of the cutting blade, so that the installation element can then be removed from the receiving opening.

Alternatively or additionally hereto, it can also be provided that on the installation element and/or on the holding element and/or on the work surface and/or between the installation element and the work surface a separating element is arranged, which is movable relative to the clamping body to cut through the clamping body and/or to separate the clamping body from the work surface and/or from the holding element.

Such a separating element can be configured as a linear element, in particular as a wire, preferably as a metal wire.

Several separating elements can also be provided, which are preferably arranged to overlap one another along the edge of the receiving opening.

To enable the separating element to be easily handled prior to its use, it can be provided that the separating element is provided with a sheath, preferably with a paper sheath.

In order to bring the separating element into a position above the clamping body in a simple manner for its subsequent use, the separating element and/or a sheath of the separating element can be fastened, preferably glued, to the holding element.

To enable the separating element to be operated simply to cut through or separate the clamping body, it is advantageous if the separating element is provided with an operating element directed out of the interstice between the holding element and the work surface.

The separating element is particularly simple to operate if it has one or more end regions and on each end region is provided with a respective operating element directed out of the interstice between the holding element and the work surface.

The variable-volume material can be applied directly onto the installation element, the holding element and/or the work surface.

Alternatively or additionally hereto, it can also be provided that at least part of the variable-volume material is arranged in a flexible sheath and is inserted into the interstice between the holding element and the work surface inside this flexible sheath.

The expansion of the variable-volume material can be better controlled by this sheath.

In addition, the sheath of the variable-volume material excludes any possibility of this material coming into contact with materials, which could be damaged by contact with this material. Therefore, the freedom in material choice is increased by the flexible sheath.

In particular, it can be provided that the variable-volume material comprises two components, which are firstly separated from one another, and that the change in volume of the variable-volume material is activated by bringing the two components in contact with one another.

These two components can, for example, be the two components of a two-component plastic foam.

In a particular configuration of a disclosed example method, it is provided that the second component is arranged inside a container, which is moved through the interior of the flexible sheath of the first component.

The second component can exit through an opening provided on the container into the outer area of the container, where a chemical reaction, for example, can proceed with the first component, which causes the change in volume of the variable-volume material.

To be able to purposefully influence the final structure of the clamping body formed from the variable-volume material and to prevent the variable-volume material from expanding into undesirable regions, e.g. into the region of the outer edge of the installation element, it can be provided that on the installation element and/or on the holding element and/or on the work surface and/or between the installation element and the work surface an expansion restricting body is arranged, the volume of which decreases on contact with the variable-volume material, preferably by plastic or elastic deformation and/or by disintegration or decomposition of the expansion restricting body.

The expansion restricting body preferably comprises a material, which is easily compressible without transferring high compressive force forces.

In particular, the expansion restricting body can contain a foam rubber material, i.e. a vulcanised latex foam based on a natural or synthetic rubber.

In addition, it can be provided that on the expansion restricting body or inside the expansion restricting body a separating element is arranged, which is movable relative to the clamping body to cut through the clamping body and/or to separate the clamping body from the work surface and/or from the holding element.

The above-described method has the further advantage that the clamping body formed from the variable-volume material can be structured so that the sealing elements usually provided between the installation element and the upper side of the work surface can be omitted.

Persons of ordinary skill in the art will further appreciate that installation elements of the aforementioned type, which can be fastened simply and quickly to a work surface have been disclosed.

A disclosed example installation element wherein a holding element has a contact surface, which on assembly of the installation element on the work surface can be subjected to a force by a clamping body formed from a variable-volume material in such a manner that the installation element is pulled towards the work surface.

In a preferred configuration of the installation element it is provided that the contact surface is arranged on a leg of the holding element, which projects towards the work surface.

It is particularly favourable if the contact surface of the holding element can be subjected by the clamping element to a compressive force directed at least partially downwards.

Persons of ordinary skill in the at will further appreciate that an example combination has been disclosed which comprises an installation element, in particular a sink, for fastening to the edge of a receiving opening for the installation element in a work surface, wherein the installation element has at least one holding element, and a variable-volume material, wherein the variable-volume material can be arranged on the installation element and/or on the holding element and/or on the work surface and/or between the installation element and the work surface, and the volume of the variable-volume material can be changed so that a clamping body is formed, which exerts a resultant force on the holding element of the installation element, which causes the installation element to be pulled towards the work surface when the installation element is arranged in the receiving opening of the work surface.

Persons of ordinary skill in the at will further appreciate that an example combination has been disclosed which comprises an installation element, in particular a sink, wherein the installation element has at least one holding element, a work surface with a receiving opening to receive the installation element and a variable-volume material, wherein the variable-volume material can be arranged on the installation element and/or on the holding element and/or on the work surface and/or between the installation element and the work surface, the installation element can be arranged in the receiving opening of the work surface, and the volume of the variable-volume material can be changed so that a clamping body is formed, which exerts a resultant force on the holding element of the installation element, which causes the installation element to be pulled towards the work surface.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method for fastening an installation element to the edge of a receiving opening for the installation element in a plate-shaped work surface, wherein the installation element is a sink and has at least one holding element, comprising:

arranging a variable-volume material on the installation element and/or on the holding element and/or on the work surface and/or between the installation element and the work surface, wherein the variable-volume material is an expandable material;

arranging the installation element in the receiving opening of the work surface;

changing the volume of the variable-volume material, so that a clamping body is formed from the variable-volume material, which exerts a resultant force on the holding element of the installation element, which causes the installation element to be pulled towards the work surface, wherein at least a part of the clamping body is arranged between the holding element and the edge of the receiving opening of the work surface and wherein the variable-volume material from which the clamping body is formed is in direct contact with the edge of the receiving opening of the work surface and/or with the holding element, and forms an integral bond with the work surface and/or with the holding element.

2. A method according to claim 1, wherein the holding element is fastened to the installation element before arranging the variable-volume material.

3. A method according to claim 1, wherein the expandable material expands so that a clamping body is formed from the expandable material, which exerts a resultant compressive force on the holding element of the installation element, which causes the installation element to be pulled towards the work surface.

4. A method according to claim 3, wherein a foamable material is used as expandable material.

5. A method according to claim 4, wherein a plastic foam, preferably a two-component plastic foam, in particular a two-component polyurethane foam, is used as foamable material.

6. A method according to claim 3, wherein the expandable material expands to its final volume in at least two stages.

7. A method according to claim 1, wherein the clamping body is connected in integral and/or force-locking manner with the work surface and/or with the holding element.

8. A method according to claim 1, wherein a cut face of the work surface facing the receiving opening for the installation element is sealed by the clamping body.

9. A method according to claim 1, wherein a holding element is used that has a contact surface, which is subjected by the clamping body to a compressive force, which has a downwardly directed component.

10. A method according to claim 9, wherein a holding element with a contact surface inclined towards the horizontal is used.

11. A method according to claim 10, wherein a holding element is used that has a contact surface, of which the edge on the work surface side lies at a lower level than the edge remote from the work surface.

12. A method according to claim 1, wherein a holding element is used, which abuts flat against the underside of the installation element.

13. A method according to claim 12, wherein the holding element abuts against a sloping edge of the installation element.

14. A method according to claim 1, wherein a holding element is used, which has a support, which is supported on the work surface when the holding element is subjected by the clamping body to a force directed in horizontal direction into the interior of the receiving opening.

15. A method according to claim 1, wherein the holding element is fastened, preferably welded, to the installation element in the region of a bend line of the installation element.

16. A method according to claim 15, wherein the holding element is fastened, preferably welded, to the installation element in the region of a bend line between a sloping edge and a substantially horizontal edge region of the installation element.

17. A method according to claim 1, wherein the clamping body partially fills an expansion chamber defined on one side by the holding element and on the other side by the work surface, preferably to approximately 50% to approximately 90% of the volume of the expansion chamber.

18. A method according to claim 1, wherein the variable-volume material expands in an expansion chamber defined on one side by the holding element and on the other side by the work surface, wherein an upper end of the expansion chamber is closed off by the holding element abutting against the work surface.

19. A method according to claim 1, wherein an edge face of the work surface defining the receiving opening is inclined towards the vertical, at least in sections.

20. A method according to claim 19, wherein the edge face of the work surface is inclined towards the vertical such that the receiving opening widens downwards.

21. A method according to claim 1, wherein a support element, against which the clamping body is supported, is fastened to the work surface.

22. A method according to claim 21, wherein the support element subjects the clamping body to a compressive force directed perpendicularly or obliquely downwards.

23. A method according to claim 21, wherein the support element has a section projecting from the work surface obliquely to a surface of the work surface.

24. A method according to claim 1, wherein a holding element is used, which is provided, preferably on its lower end, with a guide element for a cutting blade.

25. A method according to claim 1, wherein on the installation element and/or on the holding element and/or on the work surface and/or between the installation element and the work surface at least one separating element is arranged, which is movable relative to the clamping body to cut through the clamping body and/or to separate the clamping body from the work surface and/or from the holding element.

26. A method according to claim 25, wherein the separating element is configured as a wire, preferably as a metal wire.

27. A method according to claim 25, wherein the separating element is provided with a sheath, preferably with a paper sheath.

28. A method according to claim 25, wherein the separating element and/or a sheath of the separating element is fastened, preferably glued, to the holding element.

29. A method according to claim 25, wherein the separating element is provided with an operating element directed out of the interstice between the holding element and the work surface.

30. A method according to claim 29, wherein the separating element has one or more end regions and on each end region is provided with a respective operating element directed out of the interstice between the holding element and the work surface.

31. A method according to claim 1, wherein on the installation element and/or on the holding element on the work surface and/or between the installation element and the work surface an expansion restricting body is arranged, the volume of which decreases on contact with the variable-volume material, preferably by plastic or elastic deformation and/or by disintegration or decomposition of the expansion restricting body.

32. A method according to claim 31, wherein on the expansion restricting body or inside the expansion restricting body a separating element is arranged, which is movable relative to the clamping body to cut through the clamping body and/or to separate the clamping body from the work surface and/or from the holding element.

33. A method for fastening an installation element to the edge of a receiving opening for the installation element in a plate-shaped work surface, wherein the installation element is a sink and has at least one holding element, comprising:

arranging a variable-volume material on the installation element and/or on the holding element and/or on the work surface and/or between the installation element and the work surface, wherein the variable-volume material is an expandable material, and a foamable material is used as the expandable material;

arranging the installation element in the receiving opening of the work surface;

changing the volume of the variable-volume material, so that a clamping body is formed from the variable-volume material, which exerts a resultant force on the holding element of the installation element, which causes the installation element to be pulled towards the work surface, wherein at least a part of the clamping body is arranged between the holding element and the edge of the receiving opening of the work surface and wherein the variable-volume material from which the clamping body is formed is in direct contact with the edge of the receiving opening of the work surface and/or with the holding element.

34. A method according to claim 33, wherein the expandable material forms an integral bond with the work surface and/or with the holding element.

* * * * *